US008051774B2

(12) United States Patent
Hollings

(10) Patent No.: US 8,051,774 B2
(45) Date of Patent: Nov. 8, 2011

(54) PRINTING PLATE MODULE, PRINTING PRESS, AND METHOD OF MOUNTING PLATES

(75) Inventor: Tony Hollings, Whalley (GB)

(73) Assignee: Goss Graphic Systems Limited, Preston, Lancashire (GB)

( * ) Notice: Subject to any disclaimer, the term of this patent is extended or adjusted under 35 U.S.C. 154(b) by 1058 days.

(21) Appl. No.: 11/587,889

(22) PCT Filed: Apr. 29, 2005

(86) PCT No.: PCT/GB2005/050059

§ 371 (c)(1),
(2), (4) Date: Sep. 25, 2007

(87) PCT Pub. No.: WO2005/105444

PCT Pub. Date: Nov. 10, 2005

(65) Prior Publication Data

US 2008/0110360 A1 May 15, 2008

(30) Foreign Application Priority Data

Apr. 29, 2004 (GB) ..... 0409594.9

(51) Int. Cl.
*B41F 27/12* (2006.01)

(52) U.S. Cl. ..... 101/477; 101/479; 101/480

(58) Field of Classification Search ..... 101/477, 101/479, 480

See application file for complete search history.

(56) References Cited

U.S. PATENT DOCUMENTS

| | | | |
|---|---|---|---|
| 3,892,178 | A | 7/1975 | Staamann |
| 4,683,822 | A | 8/1987 | Sardella et al. |
| 4,727,807 | A | 3/1988 | Suzuki et al. |
| 4,858,528 | A | 8/1989 | Inouye et al. |
| 4,878,407 | A | 11/1989 | Harrison et al. |
| 5,012,735 | A | 5/1991 | Fischer et al. |
| 5,074,212 | A | 12/1991 | Kobler et al. |
| 5,111,744 | A | 5/1992 | Wieland |
| 5,127,328 | A | 7/1992 | Wieland |
| 5,540,151 | A | 7/1996 | Ruckmann et al. |
| 5,595,119 | A | 1/1997 | Hada et al. |
| 5,671,674 | A | 9/1997 | Nobuta et al. |

(Continued)

FOREIGN PATENT DOCUMENTS

DE 42 19 822 A1 12/1993

(Continued)

OTHER PUBLICATIONS

Written Opinion of the International Searching Authority for PCT/EP2006/061325 mailed Oct. 2, 2006, pp. 5.

(Continued)

*Primary Examiner* — Leslie J Evanisko
(74) *Attorney, Agent, or Firm* — Lando & Anastasi, LLP

(57) ABSTRACT

A printing plate module is disclosed. The module comprises a printing plate support member (3) having means (5) to locate printing plates (4) in a predetermined position thereon and, engagement means (8) on the plate support member for the releasab a engagement of the printing plate support member (3) with a printing press during a plate loading operation to locate printing plates (4) located on the plate support member (3) in a predetermined position relative to a plate cylinder (7) of the press. The invention also discloses a printing apparatus and, a method of loading printing plates onto a plate cylinder of a printing unit.

33 Claims, 16 Drawing Sheets

U.S. PATENT DOCUMENTS

| | | | | |
|---|---|---|---|---|
| 5,701,822 | A | 12/1997 | Metrope | |
| 6,510,795 | B1 | 1/2003 | Detmers | |
| 6,571,708 | B1 | 6/2003 | Rudzewitz et al. | |
| 2004/0221758 | A1* | 11/2004 | Klein et al. | 101/477 |

FOREIGN PATENT DOCUMENTS

| | | | |
|---|---|---|---|
| DE | 196 39 973 | A1 | 5/1997 |
| DE | 197 19 559 | A1 | 11/1998 |
| DE | 195 49 707 | B4 | 3/2005 |
| EP | 0 431 715 | B1 | 3/1995 |
| EP | 0 678 382 | B1 | 1/1999 |
| EP | 0 924 070 | A1 | 6/1999 |
| EP | 1 149 694 | A1 | 10/2001 |
| EP | 1 391 299 | A1 | 2/2004 |
| EP | 1 435 291 | A1 | 7/2004 |
| EP | 1 435 292 | A1 | 7/2004 |
| EP | 1 464 492 | A2 | 10/2004 |
| GB | 2 403 688 | A | 1/2005 |
| GB | 2 413 530 | A | 11/2005 |

OTHER PUBLICATIONS

International Search Report for PCT/EP2006/061325 mailed Oct. 2, 2006, pp. 5.

Written Opinion of the International Searching Authority for PCT/EP2006/062105 mailed Nov. 16, 2006, pp. 12.

International Search Report for PCT/EP2006/062105 mailed Nov. 16, 2006, pp. 7.

Patent Abstracts of Japan, JP 2000062146 (Mitsubishi Heavy Ind. Ltd.), Feb. 29, 2000, 1 pg.

International Search Report for PCT/GB2005/050059 mailed Nov. 11, 2005.

* cited by examiner

PRINTING PLATE MODULE, PRINTING PRESS, AND METHOD OF MOUNTING PLATES

This application is a National Stage Application under 35 U.S.C. §371 from PCT/GB2005/050059, filed Apr. 29, 2005, which claims priority under 35 U.S.C. §119 (a)-(d) to United Kingdom Application No. GB 0409594.9, filed on Apr. 29, 2004, both of which are hereby incorporated by reference.

BACKGROUND OF THE DISCLOSURE

The present invention relates to a module for holding printing plates ready to be transferred onto the plate cylinders of a rotary offset printing machine. The invention also relates to a printing plate loading module for loading printing plates onto a plate cylinder of a press and to a printing press including the plate-loading module according to the invention. The invention further relates to a printing system comprising the printing plate module and a printing press according to the invention. A method of mounting printing plates onto the plate cylinder of a printing unit is also disclosed.

A web offset printing press comprises a number of printing units. Each unit is designed to print matter onto a continuous web of paper as it travels through the print unit. The printed web emerging from each print unit come together in a folding unit which orientates, folds and cuts each web to produce the finished article such as a newspaper or magazine. Each unit contains at least one pair of cylinder groups or print couples comprising a rotatably mounted plate cylinder, to which one or more printing plates are attached and, a rotatably mounted blanket cylinder. The printing unit may incorporate a shaft less drive system in which each cylinder group is driven by its own drive motor that directly drives one of the cylinders of a group via a belt or gear drive and the other cylinder of that group is mechanically coupled to the driven cylinder. An inking system associated with each print couple is operable to feed ink onto the printing plates attached to the plate cylinder as the plate cylinder rotates. As the cylindrical surfaces of the plate and blanket cylinder are in rolling contact, an inked image is transferred from the printing plates onto the blanket cylinder and from the blanket cylinder onto the medium to be printed.

In large scale high volume presses used, for example, in the production of newspapers, multi-colour printing is achieved by providing each print unit with a number of printing couples arranged in pairs which are mounted vertically above one another in a stack so that the paper web travels in a vertically upward direction between each pair of print couples. A unit having four print couple pairs, i.e. eight print couples, is able to print up to four colours on each side of the paper web and is often referred to as a "four-high" unit.

When a press is prepared for a print run, at least one printing plate carrying the image to be printed must be firmly clamped to the plate cylinder of each print couple. Generally, the plate cylinder includes at least one recess or lock-up slot extending longitudinally along the surface of the plate cylinder and into which is received the leading and trailing edge of a printing plate. A clamping mechanism located in the recess engages the leading and trailing edges of an inserted printing plate and firmly holds the printing plate in position during a print run. The number of printing plates that must be attached to the plate cylinder of each print couple depends on the width of the press and whether the plate cylinder carries one or two printing plates around its circumference, i.e. whether it is a "one around" or "two around" plate cylinder. For example, in a double width one-around press, the plate cylinder may carry four printing plates across its width and one printing plate extending circumferentially around its cylindrical surface. Therefore, there could be as many as eight printing plates in a single printing couple pair and thirty-two printing plates in a four high printing unit all of which must be replaced before a new print run can be initiated. When the plate cylinder is of the "two-around" type, the number of printing plates is doubled accordingly. Therefore, it will be appreciated that even in the production of just one newspaper issue, a very large number of printing plates will be required.

It is of utmost importance to ensure that all the printing plates attached to one plate cylinder are located in very precise circumferential and lateral registration with respect to each other. It will also be appreciated that as ink of a different colour is applied to the print medium as it passes through each print couple pair of a print unit, it is also important that the printing plates are in alignment with the printing plates attached to each of the other plate cylinders of the press as any misalignment of a printing plate will result in mis-registration of the different coloured inks applied to the print medium which will reduce the quality of the final print.

To enable accurate location of the printing plates, precise detection and confirmation of the position of each printing plate must be determined during installation onto the plate cylinder. A commonly known method of aligning a printing plate on a plate cylinder and to make sure that it is located in an "in-register" position is to provide the leading edge of each plate with a number of slots that locate on pins in the recess in the plate cylinder into which the leading edge of the printing plate is received when it is attached to a plate cylinder. The position of the slots and pins are predetermined so that, when the pins have been located in the slots, the printing plate is in the correct position and the press operator can be confident that the printing plate will be positioned correctly in relation to other printing plates.

In a conventional printing machine, the press operator loads printing plates onto the plate cylinders manually so that they are accurately located in their predetermined in-register positions. However, it will be appreciated that this activity is very labour intensive and time consuming especially when a large number of printing plates need to be replaced. It also means that the press is rendered inoperable for an extended period of time and this has a significantly detrimental affect on the overall productivity of the press. In fact, many press operators simply cannot afford to shut down a press for the amount of time it takes to complete a manual plate change due to increased demand for printed matter and the very tight deadlines that need to be met.

In an attempt to reduce the setting-up time, automatic or semi-automatic printing plate changing systems have been developed in which a printing plate is automatically fed onto, and accurately located on, the plate cylinder by a printing plate feeding mechanism attached to the printing unit. In a semi-automatic plate changing system, the press operator must accurately position the printing plates in printing plate holders fixed to the printing press adjacent to each of the plate cylinders of the press. As the position of the holder is fixed, the position of the printing plate in the holder relative to its intended position on the plate cylinder is known and the printing plate can be conveyed onto the plate cylinder with its "in-register" position maintained. In an automatic printing plate changing system, the position of the plate does not rely on the accurate positioning of the printing plates in the holder but is determined by position sensors or other devices whilst the plate is fed onto the plate cylinder or, once the leading edge of the printing plate has been inserted into the recess in the plate cylinder. Therefore, in an automatic plate changing system, the press operator does not have to concern himself with the precise positioning of the printing plates within their holders.

A disadvantage with semi-automatic plate changing systems is that the press operator still has to accurately locate the printing plates in each of the holders adjacent to each of the plate cylinders on the press itself. Although this does reduce the plating-up time, as the printing plates for the next print run can be located in their holders whilst the press is still operational with another set of printing plates, it is still undesirable for people to be working on the press whilst it is running as this can be dangerous, especially when loading the holders located adjacent to the uppermost plate cylinders which are located in an elevated position. Furthermore, sensors or other position location devices are still required to ensure that the printing plates are positioned accurately with respect to the plate cylinder onto which they are being loaded during and/or after the loading process when the plates are being conveyed from their holders onto the plate cylinder.

Although an automatic plate changing system alleviates the problems with a semi-automatic system, the operator still needs to place new printing plates into the holders ready for the next print run and so must be working on the press whilst it is still running and so the potential danger associated with this task is still not avoided or reduced. Furthermore, an automatic plate changing system requires position sensors and/or other devices to accurately determine the location of the printing plates themselves as they are conveyed onto the plate cylinder. Even when the position of the printing plates before loading begins is found to be accurate, it is often found that one or more plates may shift slightly during loading and so repeated checking of the plate positions once they have been located on the plate cylinder is required.

The present invention seeks to overcome or alleviate the aforementioned problems with manual plate loading procedures as well as those associated with semi-automatic or automatic plate loading systems thereby reducing the time taken to replace the printing plates on each plate cylinder and the printing press as a whole. It also ensures more precise positioning of the printing plates as they are loaded onto the plate cylinders thereby avoiding the need for complicated detection and position sensing equipment for detecting the position of the printing plates.

SUMMARY OF THE DISCLOSURE

According to one aspect of the invention, there is provided a printing plate module for holding printing plates ready to be transferred onto a plate cylinder of a printing press during a plate loading cycle, the printing plate module comprising a printing plate support member having means to locate printing plates in predetermined positions thereon and engagement means on the printing plate support member for the temporary engagement of the printing plate support member with a printing press during a plate loading cycle to locate printing plates on the plate support member in a predetermined position relative to a plate cylinder of the press onto which printing plates are to be transferred.

The printing plate support member preferably includes means to locate a plurality of printing plates thereon so that each printing plate is located in a predetermined position on the plate support member and, in a predetermined position relative to each of the other printing plates located on the plate support member.

In a preferred embodiment, the printing plate module comprises a cartridge, the printing plate support member being slidable between a storage position in which the plate support member is received within the cartridge and, a plate loading position in which the printing plate support member extends from the cartridge to enable the engagement means to make temporary engagement with printing press during a plate loading cycle.

Advantageously, the cartridge is releasably attachable to a plate loading module on a printing press which is operable to transfer printing plates from the plate support member onto a plate cylinder with which the plate support member has become temporarily engaged, the cartridge being detachable from the plate loading module to enable it to be moved away from a printing press to facilitate loading of plates onto the plate support member.

Preferably, there is a plurality of printing plate support members in the cartridge and each printing plate support member is independently slideable between a storage position and a plate loading position for the transfer of the printing plates from any of the plate support members onto a plate cylinder by the plate loading module.

Conveniently, the or each plate support member includes a cam track which co-operates with a movable cam member on the plate loading module, when the cartridge is attached thereto, to move the plate support member from its storage into its plate loading position.

In a preferred embodiment, the means to locate printing plates on the or each plate support member comprises a plurality of pins on the or each plate support member for engagement in slots formed in a leading edge of each printing plate.

According to another aspect of the invention, there is provided a plate-loading module for transferring printing plates from a plate support member, on which printing plates are located in pre-determined positions, onto a plate cylinder of a printing press during a plate loading cycle in which the printing plate support member is in engagement with the printing press to locate printing plates on the plate support member in a predetermined position relative to said plate cylinder, the plate-loading module comprising a carriage attached to the printing press so that the carriage is movable into positions adjacent to each of the plate cylinders of the press, a support arm attached to the carriage pivotable relative thereto between a plate loading position and a retracted position and, a plate loading head attached to the remote end of the support arm, the plate loading head being operable to engage printing plates located on a plate support member in engagement with the printing press when the support arm pivots towards its loading position so that the printing plates are held by the plate loading head when the plate support member is disengaged and withdrawn from the printing press, further pivotal movement of the support arm into its loading position, after withdrawal of the plate support member from the printing press, being operable to locate a leading edge of the printing plates in a predetermined position on the plate cylinder.

In a preferred embodiment, the plate loading head is pivotally mounted on the support arm to maintain the orientation of the plate loading head relative to the plate support member when the support arm pivots between its retracted and loading positions.

The plate loading head may conveniently comprise an array of suction elements which contact the surface of the printing plates when the support arm is pivoted towards its loading position, the suction elements being operable to grasp the printing plates when activated.

The plate loading head may also comprise a pressure roller for pressing the printing plates against the plate cylinder once the plate loading head has located the leading edge of the printing plates in a predetermined position on the plate cylinder, as the plate cylinder rotates to wrap the printing plates around the plate cylinder.

According to another aspect of the invention, there is provided a printing press including a plurality of plate cylinders and a plate-loading module operable to transfer printing plates from plate support members onto the plate cylinders of the press, the plate loading module including a carriage mounted to the press and movable between a non-operative parked position into plate loading positions adjacent to each of the plate cylinders of the press.

The printing press conveniently includes an elongate guide track mounted thereon and a slide unit on the carriage in co-operation with the guide track to enable the carriage to slide along the guide track into positions adjacent to each of the plate cylinders of the press.

The slide unit ideally comprises pre-loaded roller bearings which co-operate with the guide track.

A motor is conveniently mounted to the carriage for moving the carriage along the track.

Preferably, the motor carries a pinion in meshing engagement with a toothed rack mounted to the printing press, the pinion being rotatably driven in response to rotation of the motor to move the carriage along the guide track.

Advantageously, sensing means are provided to determine the position of the carriage on the guide track so that the carriage can be stopped in different pre-determined positions adjacent to each of the plate cylinders of the press.

The printing press according to the invention most preferably includes a primary module, to which the plate cylinders are mounted, and at least one inking module, to which inking systems for applying ink to the plate cylinders are mounted, wherein the inking module is separable from the primary module to facilitate access to the plate cylinders by the plate loading module.

The carriage is advantageously mounted to the primary module so that it can move from its non-operative parked position into its plate loading positions only when the inking module has been separated from the primary module.

According to another aspect the invention comprises the printing press according to the invention including the plate-loading module according to the invention.

The printing press according to the invention preferably comprises engagement means to locate a plate support member thereon when the plate support member is in engagement with the printing press to locate printing plates on the plate support member in a predetermined position relative to said plate cylinder.

The engagement means to locate a plate support member thereon are preferably located on each plate cylinder.

The engagement means are preferably recessed below the cylindrical surface of the plate cylinder.

The present invention also provides a printing system comprising a printing plate module according to the invention and, a printing press according to the invention.

According to another aspect of the invention, there is provided a method of transferring printing plates, located on a printing plate support member in a printing plate storage module according to the invention, to a plate cylinder of a printing press according to the invention, comprising the steps of:

(a) moving a plate support member together with printing plates located thereon towards the printing press so that the plate support member temporarily engages the press to locate the printing plates in a predetermined position relative to the plate cylinder onto which plates are to be transferred, and (b) operating a printing plate loading module to transfer printing plates from the plate support member onto the plate cylinder.

The method preferably includes the step of:

(c) moving the plate loading module together with the plate support member into a position adjacent to one of the plate cylinders onto which plates are to be transferred prior carrying out step (a).

The printing press preferably includes engagement means to temporarily engage the plate support member, the engagement means being located on each of the plate cylinders, and the method preferably includes the step of rotating the plate cylinder whilst moving the plate support member towards it so that the plate support member engages with the engagement means on the plate cylinder onto which the printing plates are to be transferred to locate the printing plates in a predetermined position relative to said plate cylinder.

In a preferred embodiment, the plate support member is slideably received in a cartridge for movement between a storage position in the cartridge and an extended position for engagement with the press, the cartridge being releasably attachable to the plate-loading module and the method including the step of attaching the cartridge to the plate loading module before carrying out steps (a), (b) or (c).

The cartridge may contain a plurality of plate support members and the method may include the step of moving the cartridge relative to the plate loading module to enable the plate loading module to transfer plates from any one of the plate support members onto different plate cylinders of the press.

According to another aspect of the invention, there is provided an apparatus for mounting a set of printing plates to an offset rotary printing press comprising a plate cylinder having a lock-up slot, the apparatus comprising a plate loading module associated with the printing press for inserting a lead edge of each printing plate into a lock-up slot in a plate cylinder, a plate support member having locating means to enable the printing plates to be pre-positioned relative to each other on the plate support member, the plate support member also including cooperating means for engagement with corresponding cooperating means on a plate cylinder when the plate support member together with the printing plates is moved toward a plate cylinder to locate the pre-positioned printing plates in a predetermined location relative to a lock-up slot on a plate cylinder, the plate loading module being operable to transfer the pre-positioned printing plates from the plate support member and insert the lead edge of each printing plate into a lock up slot whilst maintaining the relative pre-positioning of the printing plates.

According to yet another aspect of the invention, there is provided a method of mounting a set of printing plates to a plate cylinder of an offset rotary printing press comprising a plate cylinder having a lock-up slot, the method including the steps of:

(a) locating a set of printing plates in predetermined relative positions on a plate support member, (b) moving the plate support member together with the pre-positioned printing plates located thereon towards the plate cylinder so that cooperating means on the plate support member and on the plate cylinder releasably engage to locate the pre-positioned printing plates in a predetermined position relative to the lock-up slot on the plate cylinder, (d) operating a printing plate loading module associated with the printing press to convey the pre-positioned printing plates from the plate support member and to insert the lead edge of each printing plate into the lock-up slot whilst maintaining the relative pre-positioning of the printing plates.

Step (b) preferably includes the step of rotating the plate cylinder so that the cooperating means on the plate support member and on the plate cylinder releasably engage.

In a preferred embodiment, the plate support member is mounted in a cartridge and the method preferably includes the step of mounting the printing plates on the plate support member in the cartridge in a location remote from the press and moving the cartridge into a plate loading position in which the plate support member can move toward the plate cylinder so that cooperating means on the plate support member and on the plate cylinder releasably engage to locate the pre-positioned printing plates in a predetermined position relative to the lock-up slot on the plate cylinder.

BRIEF DESCRIPTION OF THE DRAWINGS

Embodiments of the invention will now be described, by way of example only, with reference to the accompanying drawings, in which.

DETAILED DESCRIPTION OF THE DISCLOSURE

Figure 1:
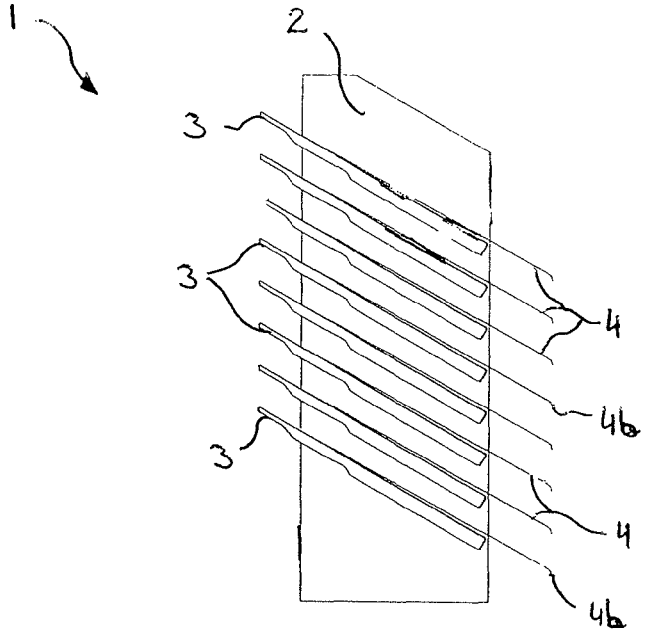
FIG. 1 shows a simplified side view of a printing plate storage module according to a first aspect of the invention.
Figure 2:
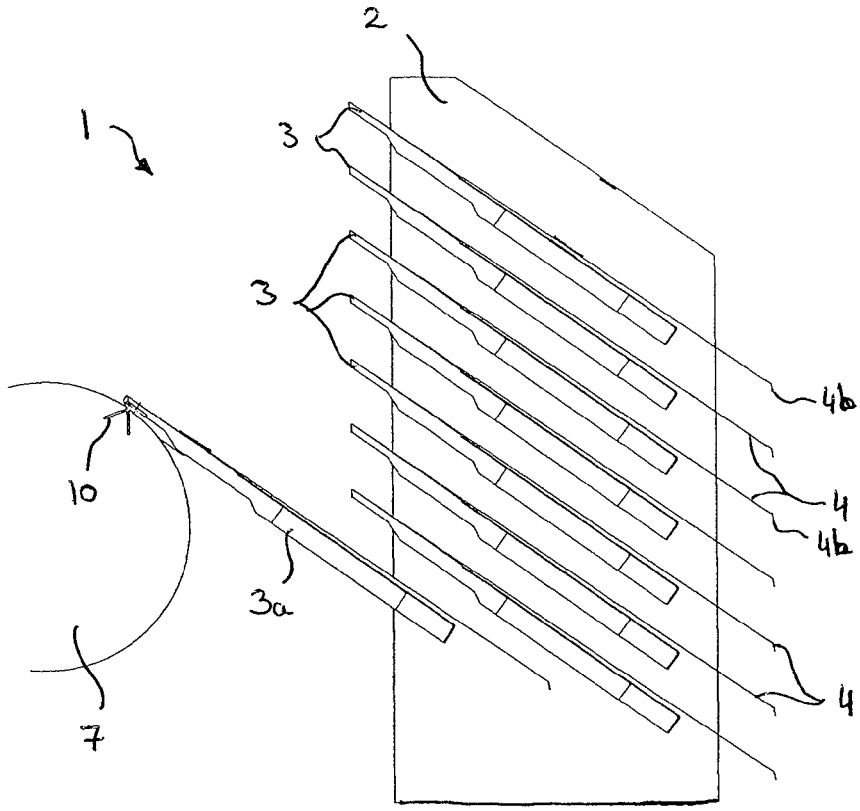
FIG. 2 shows the side view of FIG. 1 but with a plate support member in its extended position and in engagement with a plate cylinder onto which the printing plates located on the plate support member are to be loaded.

Referring initially to FIG. 1, there is shown a printing plate storage module 1 according to an embodiment of the invention. The module 1 comprises a housing or cartridge 2 containing a plurality of printing plate support members or trays 3 spaced from each other but located one above the other in stacked relation like drawers. The printing plate support members 3 are mounted in the cartridge 2 so that each of them can be independently slid between a first storage or retracted position in which the printing plate support members 3 are positioned substantially within the cartridge 2 and, a second extended position in which the printing plate support members 3 extend from the cartridge 2. All the printing plate support members 3 shown in FIG. 1 are in their storage position. However, in FIG. 2, one printing plate support member 3*a* is shown in its extended position. The reason why the printing plate support members 3 can slide out of the cartridge 2 into extended positions will become apparent from the following description.

Each printing plate support member 3 includes a number of upstanding pins 5 (see FIG. 5) thereon to locate printing plates 4 in predetermined positions on the printing plate support members 3 so that the position of each of the printing plates 4 relative to the printing plate support member 3 on which they are mounted is known, as is the position of each printing plate 4 relative to each of the other printing plates 4 located on that printing plate support member 3. In FIG. 1, printing plates 4 are shown in their located positions on each of the printing plate support members 3. The pins 5 on the printing plate support members 3 locate in slots (not shown) formed in the leading edge 4*a* (see FIG. 5) of the printing plates 4. The location of the pins 5 may be adjustable with respect to the plate support members 3 to allow compensation for fan-out. This arrangement mimics the way in which printing plates 4 are located on plate cylinders in conventional printing press arrangements. However, instead of providing the pins 5 in the recess in the lock-up slot of the plate cylinder, the pins 5 are provided on the printing plate support members 3. As the relative positions of the printing plates 4 are set on the printing plate support members 3, the need for pins 5 in the plate cylinder is removed. However, it will be appreciated that the provision of locating pins in the plate cylinder lock-up slot is not precluded to facilitate manual loading. It is envisaged that when the plates are to be loaded manually, they will be punched to fit onto slightly thinner pins located in the lock-up slot. This will avoid any conflict between the auto-loading system and manual loading.

Figure 5:
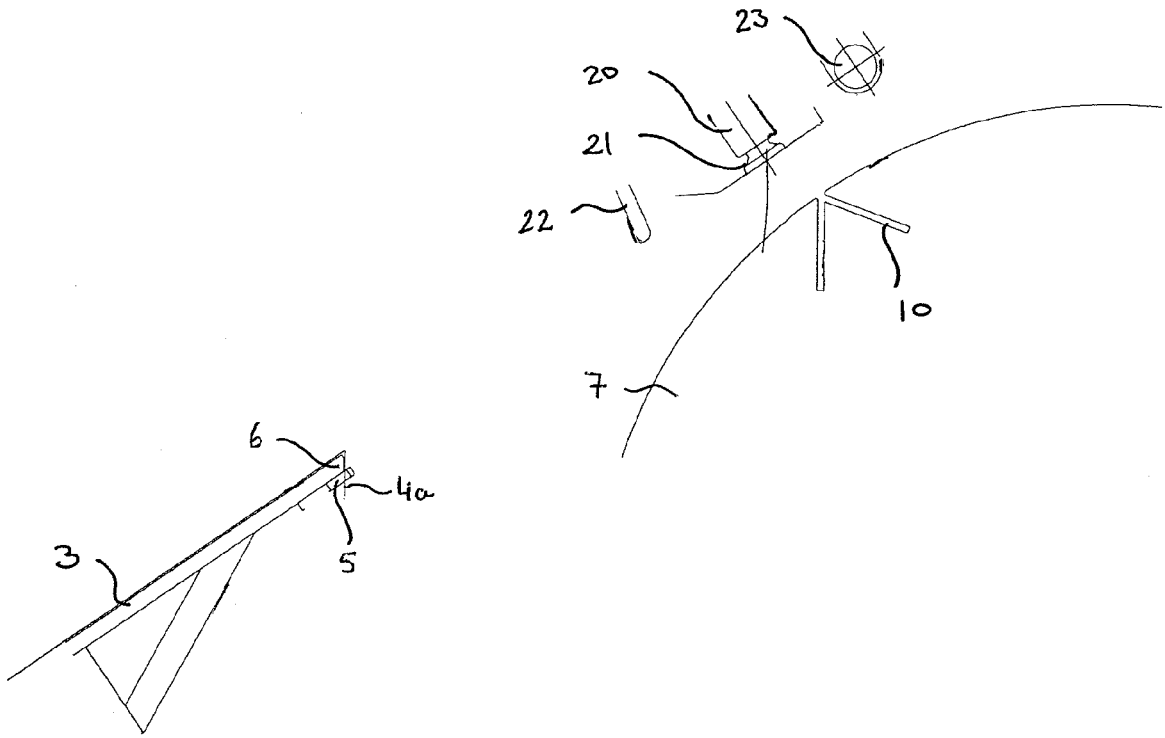
FIG. 5 is a simplified side view of the main components of the plate loading module and the plate cylinder located with its lock-up slot in a position ready to receive printing plates during a loading operation.

As can be seen most clearly from FIG. 5 of the drawings, each printing plate 4 lies flat on its printing plate support member 3 with its leading edge 4*a* overhanging the front lip 6 of the plate support member 3. The pins 5 upstand or protrude forward of the front lip 6 to engage with the slots in the printing plates 4.

Figure 3A:
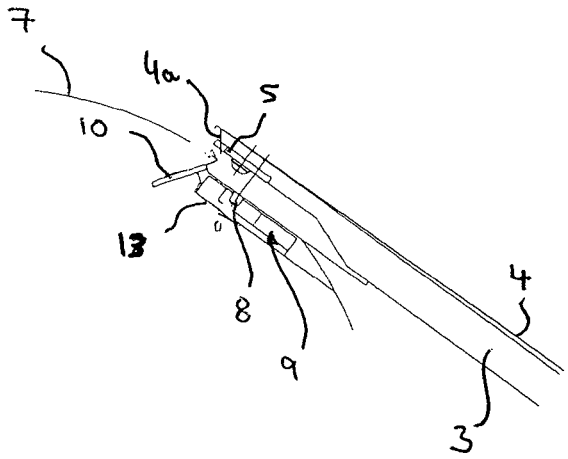
FIG. 3A is an enlarged partial view of FIG. 2 showing the connection between the plate support member and the plate cylinder.
Figure 3B:
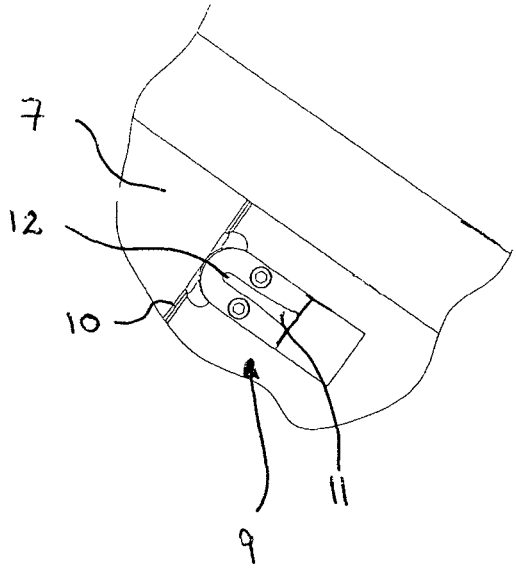
FIG. 3B is a partial top plan view of one end of a plate cylinder showing the engagement member to which the plate support member attaches to the plate cylinder.

When printing plates 4 located on the printing plate support members 3 are to be loaded onto a plate cylinder 7 of a printing unit (not shown), the cartridge 2 is positioned relative to the plate cylinder 7 so that when the relevant printing plate support member 3 moves out of the cartridge 2 from its retracted into its extended position, it releasably engages with the printing unit. In a preferred embodiment, the printing plate support member 3 releasably engages directly with the plate cylinder 7 of the printing press that is to receive the printing plates 4 from that plate support member 3. To facilitate this engagement, each of the printing plate support members 3 includes a pair of engagement pins 8 (see FIG. 3A) for releasable engagement with corresponding engagement members 9 at each end of the plate cylinder 7. The engagement members 9 are positioned next to a lock-up slot 10 in the plate cylinder 7, which receives the leading edge 4*a* of the printing plates 4. A partial plan view of one end of a plate cylinder 7 showing one of the engagement members 9 is illustrated in FIG. 3B from which it can be seen that it comprises an elongate guide channel or slot 11 terminating at an end stop 12 next to the lock-up slot 10 in a radial direction. Another engagement member is provided in the same position at the other end of the plate cylinder 7 although this engagement member (not shown) is provided with a wider slot or clearance for the pin 8 so that only the guide slot 11 is used to locate the plate support member 3 laterally and provision is provided for expansion and contraction due to changes in temperature. However, the clearance slot does terminate in an end stop which is used to position the plate support member 3 in a circumferential direction. The clearance slot may incorporate a biasing spring, such as a leaf spring, which acts against the pin 8 to push the plate support member 3 against one side of the slot 11 and thereby accurately locate the plate support member 3 in a lateral direction. As can be seen from the side end view of FIG. 3A, the engagement member 9 is located on a flat shoulder 13 recessed into the cylindrical surface of the plate cylinder 7 so that the cylindrical surface of the plate cylinder 7 or, more specifically the printing plates 4 attached to the plate cylinder 7, are in rolling contact with the cylindrical surface of a blanket cylinder (not shown) which forms the print couple together with the plate cylinder 7.

When the cartridge 2 is located adjacent to a printing unit in the correct position, a printing plate support member 3 moves from its retracted into its extended position so that the engagement pins 8 on the plate support member 3 slides along the guide channel 11 and locates against the end stops 12 of the engagement members 9 to precisely position the plate support member 3 with respect to a lock-up slot 10 in the plate cylinder 7. A plate support member 3*a* is shown in an engaged position in FIG. 2. When a printing plate support member 3 is fully located against the end stops 12, it is circumferentially and laterally located relative to the plate cylinder lock-up slot 10 and accurate presentation of the printing plates 4 relative to the cylinder 7 is obtained ready for the plate loading sequence to take place, as described in more detail below.

It will be appreciated that the plate cylinder 7 may need to be rotated so that the engagement members 9 are presented to the engagement pins 8 on the plate support member 3 when the plate support cylinder 3 extends towards the plate cylinder 7 and so that the lock-up slot 10 on the plate cylinder 7 is in the correct position to receive the printing plates 4 when they are fed onto the plate cylinder 7 from the printing plate support member 3. When a plate support member 3 is located against the end stops 12, the lead edge 4*a* of the printing plates 4 which overhang the front lip 6 of the plate support member 3 are positioned directly above the lock-up slot 10.

It will be appreciated that the position of the cartridge 2 and the plate support members 3 relative to the cartridge 2 is not absolutely critical to ensure precise positioning of the printing plates 4. In fact, the plate support members 3 may have a degree of freedom of movement within the cartridge 2 in which they are located so that they will self-adjust into the correct position as the engagement pin 8 travels up the guide channel 11 and locates against the end stops 12 on the plate cylinder 7. Once in this position, the plate support member 3 is in a precise predetermined relative position to the lock-up slot in the plate cylinder 7, as are the printing plates 4 located in precise positions on the plate support members 3.

The printing plates 4 may be loaded onto the printing plate support members 3 in the vicinity of the printing unit. However, in a preferred arrangement, the cartridge 2 is loaded with printing plates 4 in the pre-press plate making area so that the printing plates 4 can be loaded onto the printing plate support members 3 directly from the vision bender at the end of a computer to plate (CTP) making line. It is envisaged that the printing plates 4 will be manually loaded onto the plate support members 3. However, it will be appreciated that an automatic method for conveying new printing plates 4 from the plate making machinery and for loading them onto the plate support members 3 is also envisaged. To facilitate loading, the plate support members 3 may be moved into their extended positions before being retracted back into the cartridge 2 when the required number of printing plates 4 has been positioned thereon. Once all the printing plate support members 3 of a cartridge 2 have all been loaded with printing plates, the cartridge 2 is transported to a printing unit so that the printing plates 4 can be transferred from the plate support members 3 to the plate cylinders 7 of the printing unit. A conveyor system may be provided to facilitate the transport of the cartridge 2 from the pre-press plate making area into the vicinity of the printing units. Rather than transport the cartridge 2 directly to the printing unit for immediate loading, it will also be appreciated that it could be moved into an intermediate storage area or buffer system whilst other cartridges 2 are loaded with printing plates 4. This would enable the plate cylinders 7 of different printing units of the same printing press to be loaded with printing plates 4 simultaneously, each cartridge 2 being loaded with the printing plates 4 for the plate cylinders 7 of one printing unit.

Once the cartridge 2 has arrived at a press unit, it releasably couples to a plate-loading module mounted on the printing unit and located in a parked non-operative position above the printing unit. The plate loading module is movable into different positions adjacent to each of the plate cylinders of the press together with the cartridge so that a predetermined printing plate support member may engage with a predetermined plate cylinder 7 to enable the printing plates located on each of the printing plate support members 3 to be loaded onto a corresponding plate cylinder 7 by the plate loading module. The construction and operation of the plate-loading module will now be described.

The printing plates 4 are transferred from the printing plate support members 3 onto the plate cylinders 7 by a plate-loading module. Each printing unit is provided with a plate-loading module which is operable to load printing plates 4 onto each of the plate cylinders 7 of that unit from the plate support members 3 of a cartridge 2. The plate loading module is also operable to engage the plate support members 3 of a cartridge 2, when the cartridge is in position adjacent to a printing unit, to drive each of the plate support members 3 between its retracted and extended positions and thereby remove the requirement for the cartridge 2 to have its own power supply, as will be explained in more detail below.

The plate-loading module 25 comprises a plate loading head 20 in the form of a bar that extends substantially across the width of the plate cylinder 7 and the printing unit. The plate loading head 20 carries a series of suction cups 21 operable to grasp printing plates 4 on the plate support members 3 when activated. The plate-loading module also comprises a pusher bar 22, and a pressure roller 23. As the printing plates 4 are presented to the plate cylinder 7 in pre-registered relative positions in their printing plate support members 3 and with the lead edge 4*a* of each of the printing plates 4 positioned directly above the lock-up slot 10 in the plate cylinder 7 (as shown most clearly in FIG. 3A), the complexity of the loading operation is greatly reduced because the plate loading head 20 only has to maintain the presented relationship during loading. A partial view of the main components of the plate loading module showing their relative positions is illustrated in FIG. 5, and their function will now be described with reference to the plate loading sequence illustrated in FIGS. 6A to 6J of the accompanying drawings.

A plate loading sequence is initiated after a cartridge 2, having a set of printing plates 4 thereon, is moved into a position adjacent to the plate cylinder 7 of a printing unit and on which those printing plates 4 are to be loaded.

Figure 4:
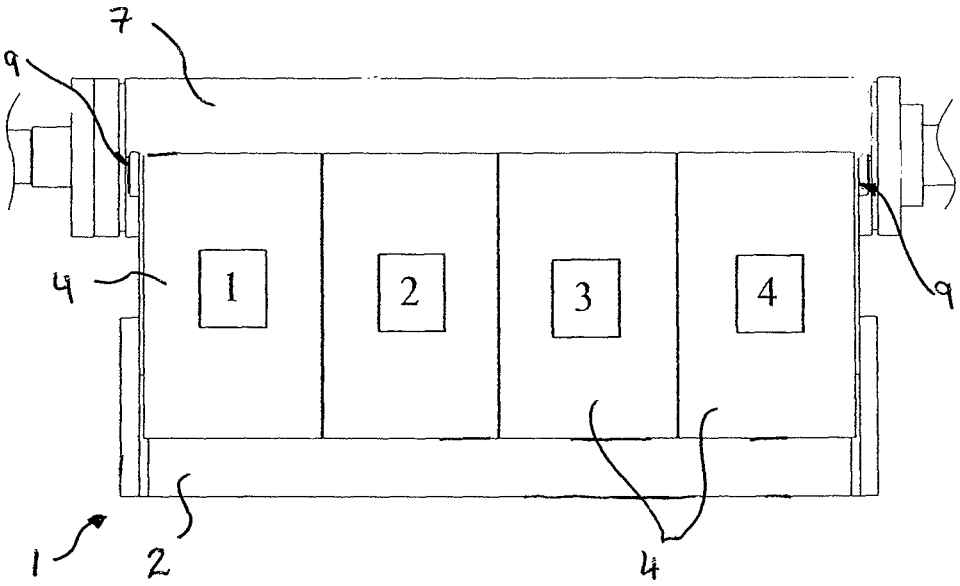
FIG. 4 is a simplified top plan view of a plate cylinder and cartridge with a plate support member, with four printing plates located thereon, in its extended and engaged position.

Firstly, a selected plate support member 3 carrying the printing plates 4 is moved into an extended position from the cartridge 2 towards the plate cylinder 7 (in the direction of arrow "A" in FIG. 6A) whilst the plate cylinder 7 rotates or indexes (in the direction of arrow "B" in FIG. 6A) so that, when the plate support member 3 and the plate cylinder 7 come together, the engagement pins 8 on the plate support member 3 slide up the guide channel 11 of the engagement member 9 on the plate cylinder 7 and engage against the stop members 12 at the end of the guide channel 11 and clearance slot. The plate support member 3 is now held firmly in a precise circumferential and lateral position relative to the plate cylinder 7 with accurate parallel and lateral alignment and the printing plates 4 are now held firm ready for loading. A simplified plan view of the cartridge 2 with a printing plate support member 3, carrying four printing plates 4, and in its extended position in engagement with a plate cylinder 7 is shown in FIG. 4. As the plate support member 3 is mechanically coupled to the plate cylinder 7 before the loading operation begins, its position is held firm and it cannot move as the plate loading module grasps the printing plates and so exact positioning of the printing plates 4 is maintained.

Figure 6A:
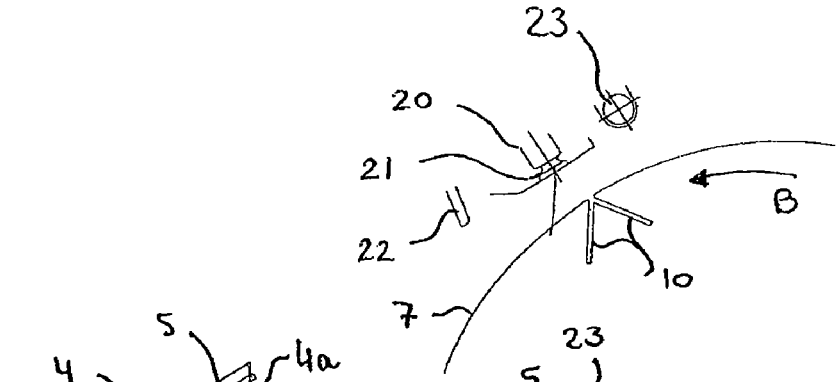
FIGS. 6A to 6J show the sequence of steps involved in a printing plate loading operation.
Figure 6B:
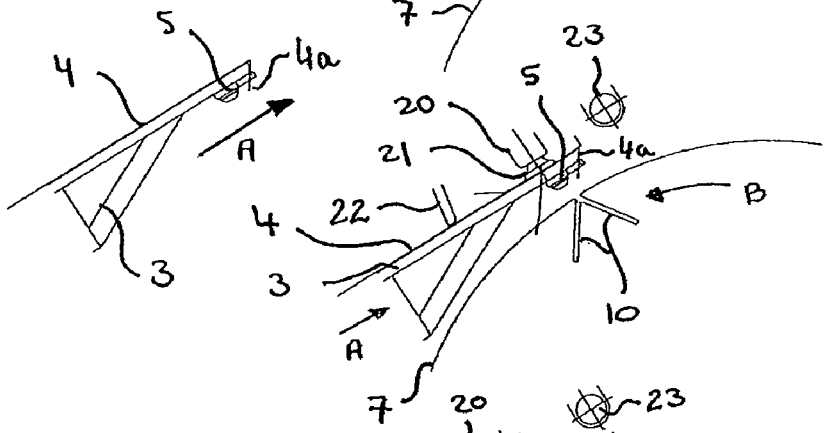

In FIG. 6B, the plate cylinder 7 has stopped rotating and the plate support member 3 is in its fully extended position with its engagement pins 8 fully home against the stop members 12. It can be seen that the lead edges 4*a* of the printing plates 4 that overhanging the plate support member 3 are now located directly or almost directly above the lock-up slot 10 in the plate cylinder 7 and so the distance through which the printing plates 4 must be moved by the plate loading mechanism is very short and in just one downward direction.

Figure 6C:
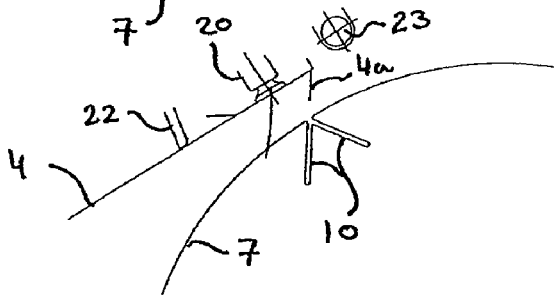

Next, and as shown in FIG. 6B, the plate loading head 20 rotates so that the suction cups 21 engage with the surface of the printing plates 4 on the plate support member 3 and suction is applied to grip the printing plates 4. Once suction has been applied, the printing plates 4 are held by the plate loading head 20 and the plate support member 3 can be retracted, in the direction of arrow "D", as shown in FIG. 6C. Because the lead edges 4*a* of the printing plates 4 overhang the plate support members 3, the printing plates 4 slide off the front of the plate support members 3 as the plate support members 3 are retracted and so there is no need for the plate loading head 20 to actually lift the printing plates 4 up off the plate support members 3.

Figure 6D:
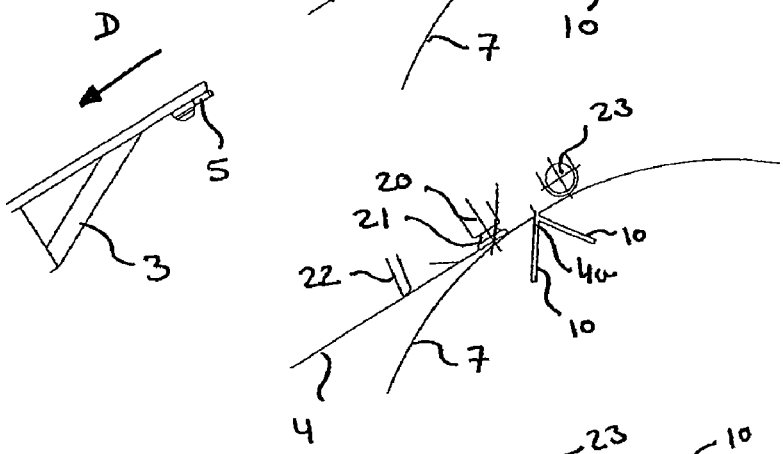
Figure 6E:
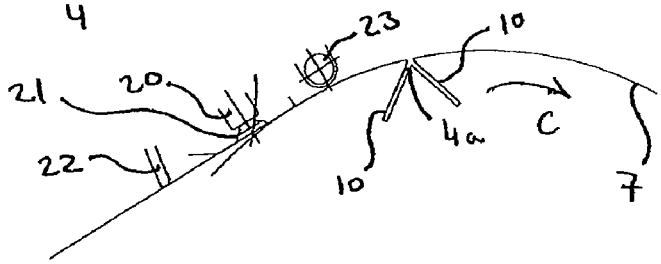
Figure 6S:
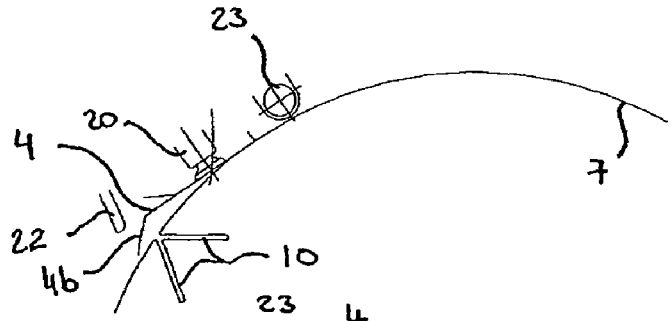
Figure 6G:
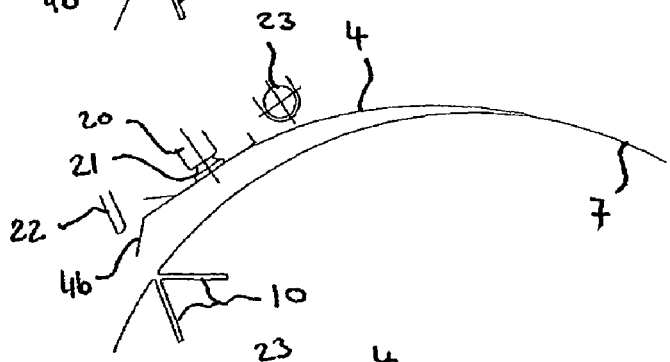
Figure 6H:
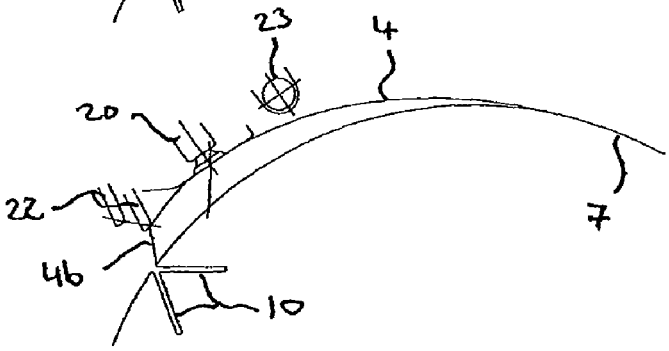
Figure 6I:
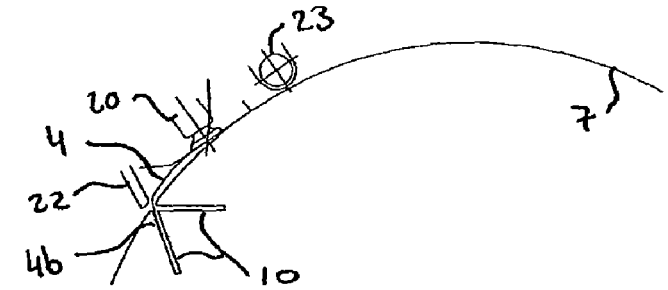
Figure 6J:
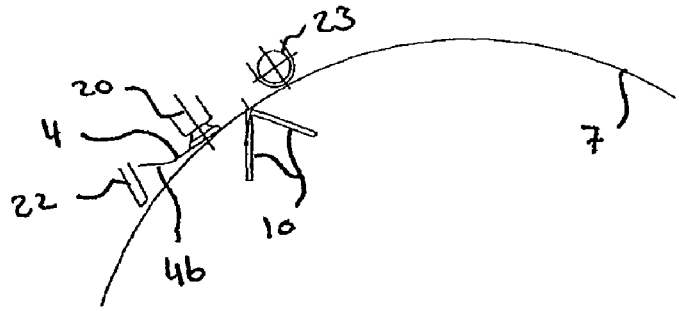

Once the plate support member 3 has been retracted, the plate loading head 20 is lowered towards the surface of the plate cylinder 7 so that the lead edge 4*a* of the printing plates 4 locates in the lock-up slot 10, as shown in FIG. 6D. Once the lead edges 4*a* of the printing plates 4 have been inserted, the suction is released and the loading head 20 retracted slightly. The plate cylinder 7 is then rotated (in a clockwise direction as shown in the drawings in the direction of arrow "C") so that the pressure roller 23 passes over the lock-up slot 10 onto the printing plates 4 and thereby ensures that the lead edges 4*a* are fully inserted into the lock-up slot 10, as shown in FIG. 6E. The plate cylinder 7 continues to rotate in the direction of arrow "C" and the pressure roller 23 wraps the printing plates 4 around the plate cylinder 7 as it does so. Once the trailing edge 4*b* of the printing plates 4 is reached, the loading head 20 is lowered once again, as shown in FIG. 6F and suction is applied to grasp the trailing end 4*b* of the printing plates 4. Once the printing plates 4 have been grasped, the loading head 20 is retracted to lift the trailing edge 4*a* of the printing plates 4 off the plate cylinders 7, as shown in FIG. 6G. The pusher bar 22 is then activated to inwardly deflect the trailing edge 4*b* of the printing plates 7, as shown in FIG. 6H, so that once the loading head 20 is lowered once again, the trailing edge of the plates drops into the lock-up slot, as shown in FIG. 6I. Once the trailing edge 4*b* has been located in the lock up slot 10, the plate cylinder 7 is indexed further forward, in the direction of arrow "C" to ensure that the pressure roller 23 pushes the trailing edge 4*b* fully into the lock-up slot 10, as shown in FIG. 6J.

The above procedure is repeated to load another row of printing plates 4 from another plate support member 3. Alternatively, the plate loading head 20 returns to a raised position to allow it to move to another cylinder 7 together with the cartridge 2.

A more detailed view of the plate loading module 25 and plate loading sequence is shown in FIGS. 7 to 11. As will be described in more detail later, the plate loading module 25 is mounted to the printing unit side frame members 26 and slides in a vertical direction (indicated by arrow "E" in FIG. 7) in a path adjacent to the plate cylinders 7 of one side of the print unit 36 so that it may be located in a plate loading position corresponding to each of the plate cylinders 7 of that side of the unit and in a parked position above the printing unit when not being used. Another plate loading module 25 is mounted to the printing unit side frame members 26 for movement in a vertical direction on the opposite side of the web path to load printing plates 4 onto the plate cylinders 7 on that side of the print unit 36. As only two plate loading modules 25 are required per print unit to load printing plates 4 onto all the plate cylinders 7 of that print unit 36, each of those plate loading modules 25 being movable into a loading position adjacent the plate cylinders 7 on one side of the print unit 36, a separate plate loading mechanism located adjacent to each plate cylinder 7 is not required.

Figure 7:
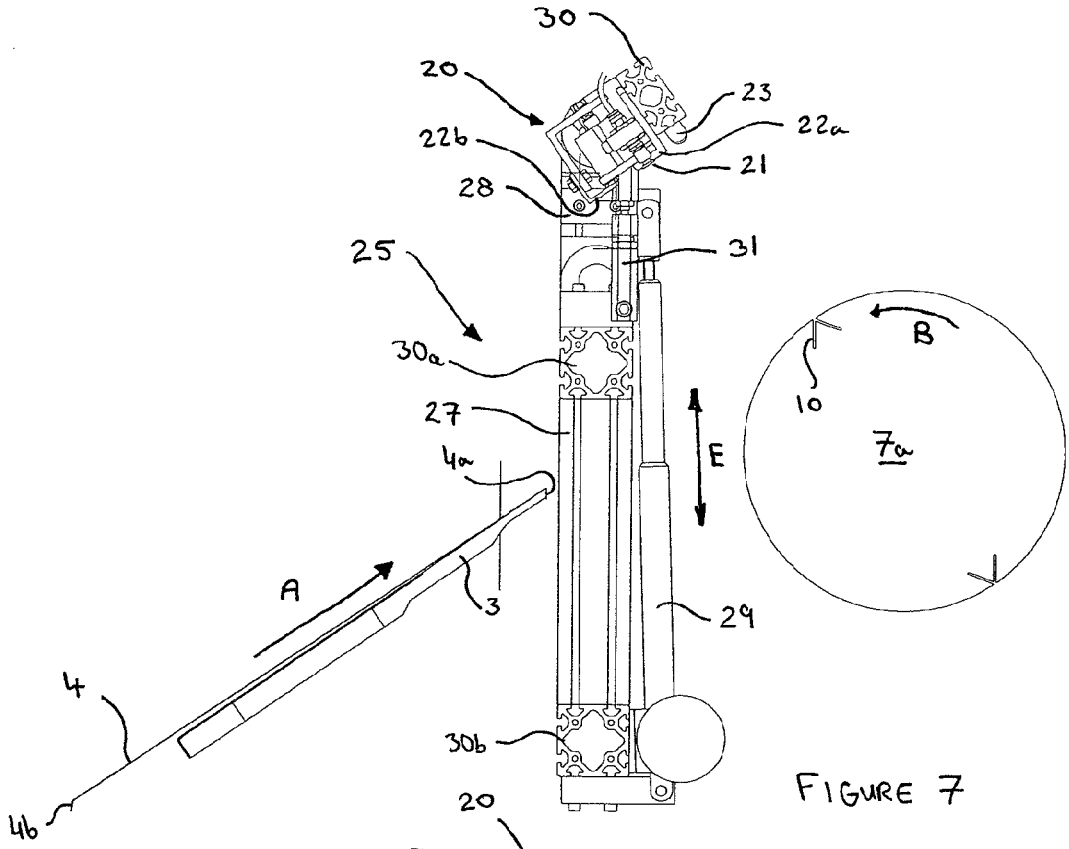
FIG. 7 illustrates an end view of the plate loading module in its raised position located between a plate cylinder and a plate support member.

The plate loading module 25 includes a pair of generally upright and elongate support frame members 27 each of which are slideably mounted on the printing unit side frame members 26 between which the plate cylinders 7 are supported. A support arm 28 is pivotally mounted at one end to the upper end of each of the support frame members 27 and is movable from a raised position in which the support arm 28 generally forms a longitudinal extension of the support frame members 27 (as shown in FIG. 7) and, a lowered, operative position in which the support arm 28 pivots (in the direction indicated by arrow "F" in FIG. 8) with respect to the support frame members 27 to load printing plates 4 onto a plate cylinder 7 in response to activation of a linear actuator 29 extending between each of the support frame members 27 and their respective support arms 28. As shown in the front view of FIG. 11, the remote end of the support arms 28 are joined by a cross-member 30 which extends across the width of the print unit and to which the plate loading head 20 is mounted so that it moves as the support arms 28 pivot relative to the support frame members 27. The cross-member 30 is pivotally mounted to the support arms 28 via levers 31 so that the plate loading head 20 maintains the same angle relative to the printing plates 4 despite moving from a raised to a lowered position. A pair of bracing cross-supports 30*a*, 30*b* also extend between the support frame members 27 across the width of the printing unit although these have been omitted from the FIG. 11 view.

Referring to FIG. 7, an end view of the plate loading module 25 is shown with its support arms 28 raised and in a position ready to load printing plates 4 from plate support member 3 onto plate cylinder 7*a*. The plate support member 3 is moving in the direction of arrow "A" toward the plate cylinder 7*a* and the plate cylinder 7*a* is indexing, in the direction of arrow "B", to position the lock-up slot 10 in the correct position so that the plate support member 3 and the plate cylinder 7*a* will engage, as has already been explained in detail above. It will be appreciated that the plate support member 3 moves between the support frame members 27 and in-between the bracing cross supports 30*a*,30*b* as it travels in the direction of arrow "A" toward the plate cylinder 7*a*.

Figure 8:
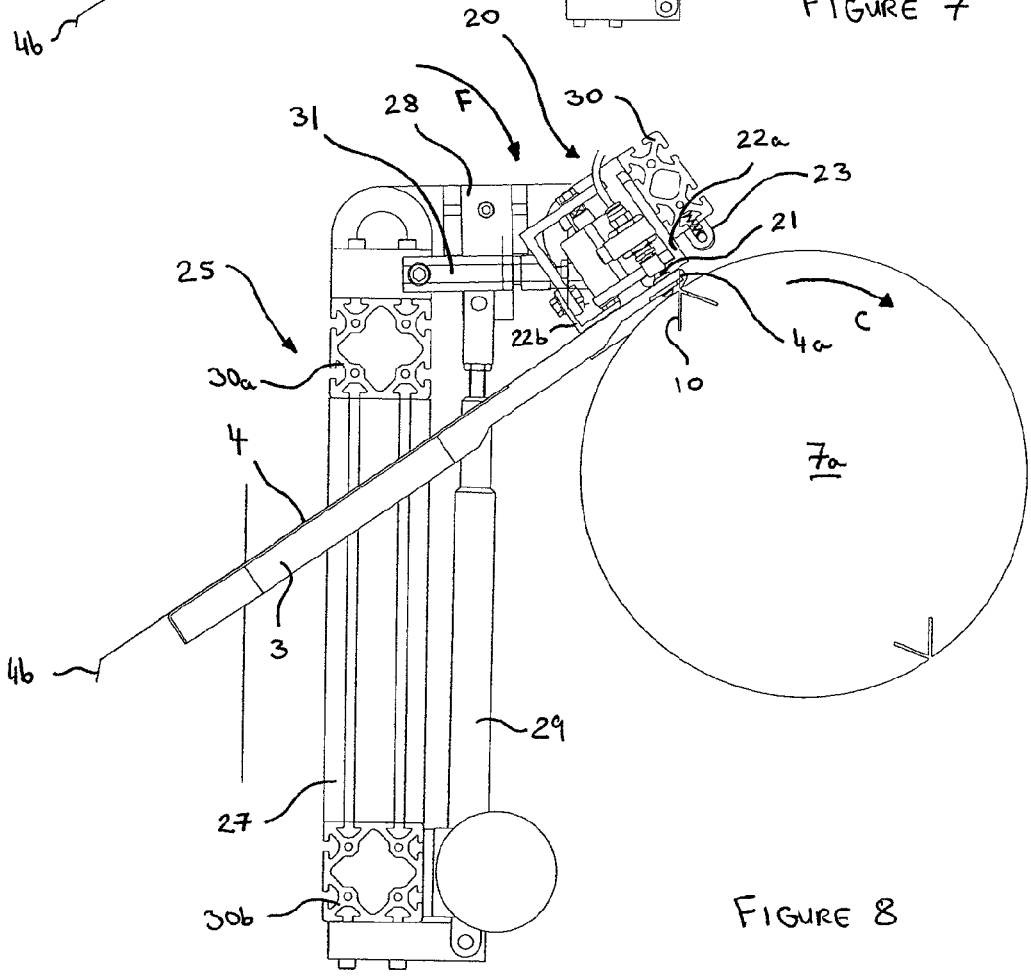
FIG. 8 is the end view of FIG. 7 with the support arm in a lowered position in which the plate loading head is in engagement with the printing plates mounted to the plate support member which has moved into engagement with the plate cylinder ready for loading.
Figure 9:
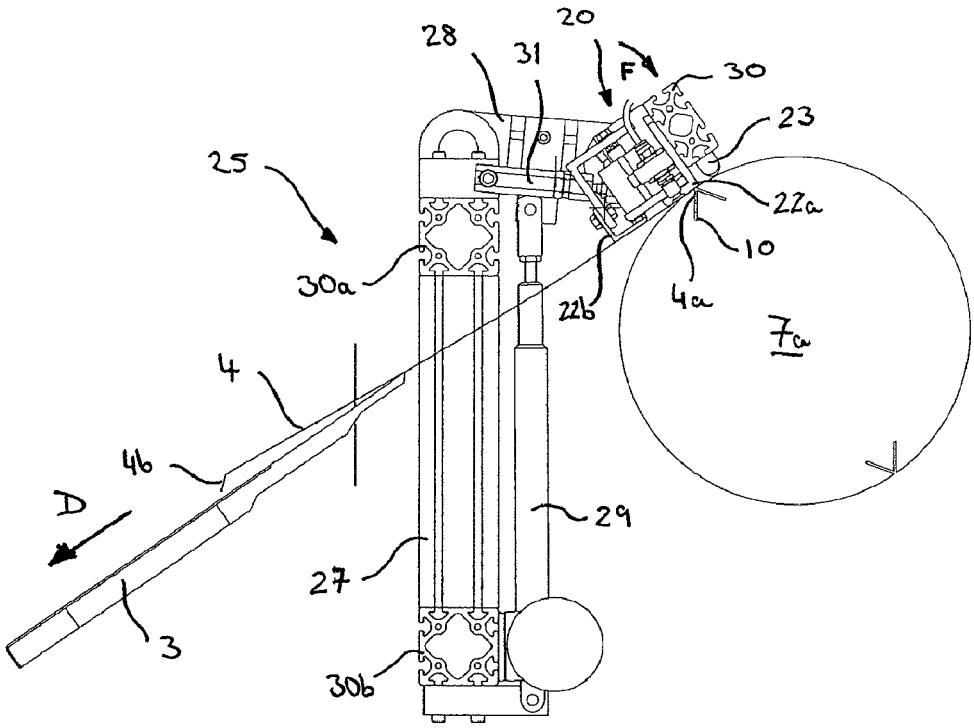
FIG. 9 is the end view of FIGS. 7 and 8 but shows the position of the loading head after the lead edge of the printing plate has been pushed into the lock up slot in the plate cylinder and the plate support member retracted.

When the plate support member 3 has located on the plate cylinder 7*a*, the linear actuator 29 is operated so as to cause the support arms 28 to rotate so as to pivot the loading head 20 down toward the printing plates 4 on the plate support member 3 in the direction of arrow "F", as shown in the end view of FIG. 8. As the support arms 28 rotate, the cross member 30 pivots with respect to the support arms 28 to maintain its angular position with respect to the printing plates 4 and so that the suction cups 21 which are parallel to the surface of the printing plates 4 when the support arms 28 are raised, remain parallel to the surface of the printing plates 4 as the support arms 28 are lowered and contact the upper surface of the printing plates 4. Suction is then applied to the plates 4 via the suction cups 21. The plate support member 3 is then retracted, in the direction of arrow "D", and the support arms 28 lowered further in the direction of arrow "F" so that the lead edge 4*a* of the printing plates 3 locate in the lock-up slot 10 in the plate cylinder 7*a*, as shown in the end view of FIG. 9. The suction is now deactivated and the plate cylinder 7*a* rotated in the direction of arrow "C" to draw the printing plates 3 around the circumferential surface of the plate cylinder 7*a*.

Figure 10:
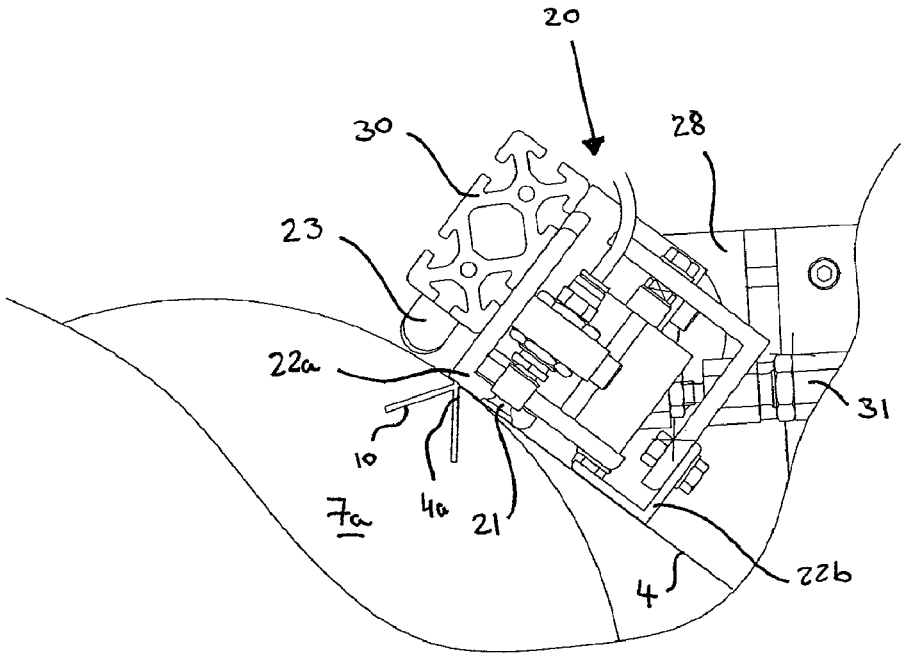
FIG. 10 is an enlarged end view of a portion of the plate loading mechanism showing the plate loading head in more detail.

As can be seen more clearly from the enlarged partial end view of FIG. 10, the lead edge 4*a* of the printing plates 4 are forced into the lock-up slot 10 by a lead edge pusher bar 22*a* and, as the plate cylinder 7*a* rotates, the printing plates 4 are wrapped around the plate cylinder 7*a* by the pressure roller 23. When the plate cylinder 7*a* has rotated through approximately 360 degrees (or 180 degrees for a two-around plate cylinder), a tail edge pusher bar 22*b* forces the tail edge 4*b* of the printing plates 4 into the lock-up slot 10. Once the lead and tailing edges 4*a*, 4*b* of the printing plates 4 are fully inserted into the lock-up slot 10, the support arms 28 pivot upwardly back into their raised position and out of the way.

Figure 10A:
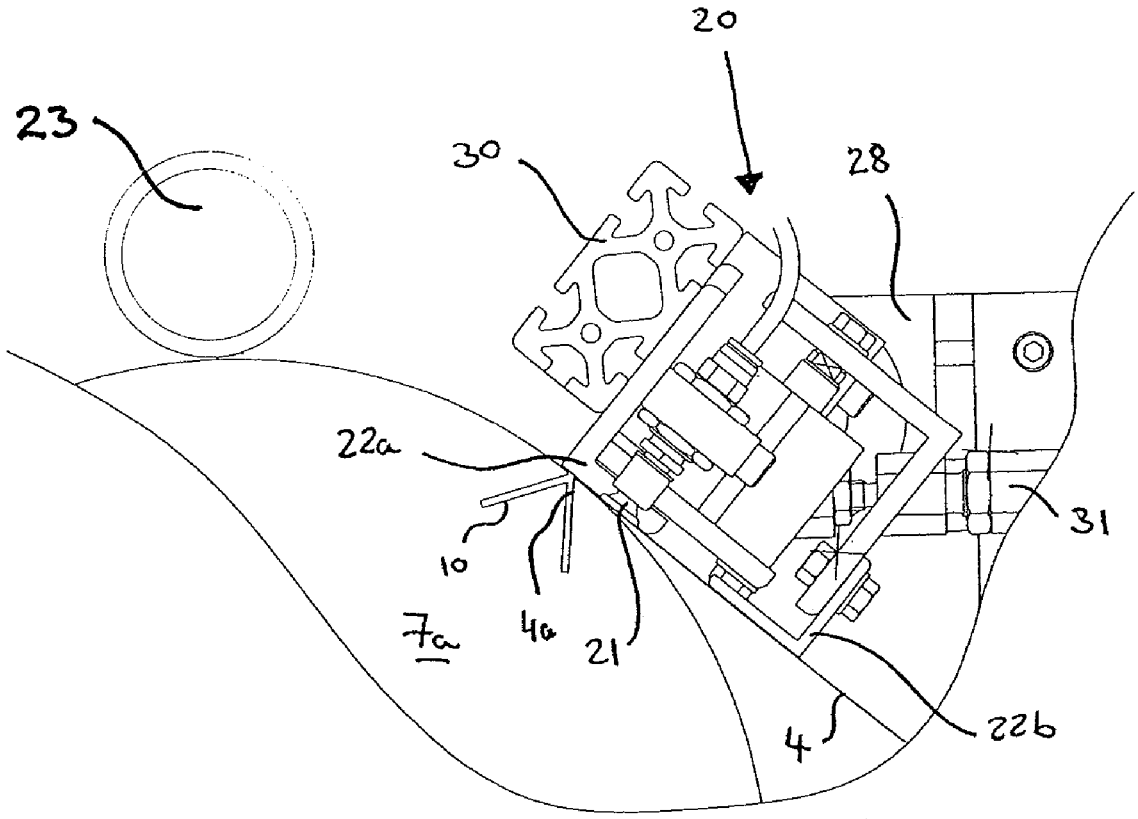
FIG. 10A shows the same view of the plate loading head as FIG. 10 but with a separate, rather than integral, pressure roller 23.
Figure 11:
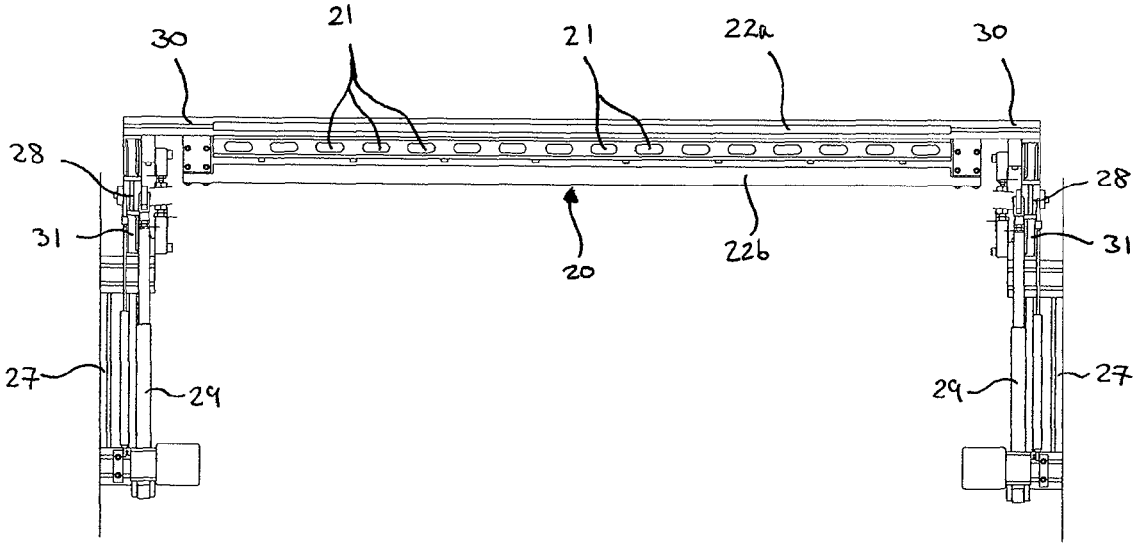
FIG. 11 is a front view of the plate loading module illustrated in FIGS. 7 to 10.

Although the pressure roller 23 has been described and shown as forming part of the plate loading head 20, it will also be appreciated that the pressure roller may be entirely separate from the plate loading module which is not attached to the plate loading head 20. This would then enable the pressure roller 23 to be raised and lowered independently to the loading head 20. FIG. 10A shows the same view of the plate loading head as FIG. 10 but with a separate, rather than integral, pressure roller 23.

Figure 12:
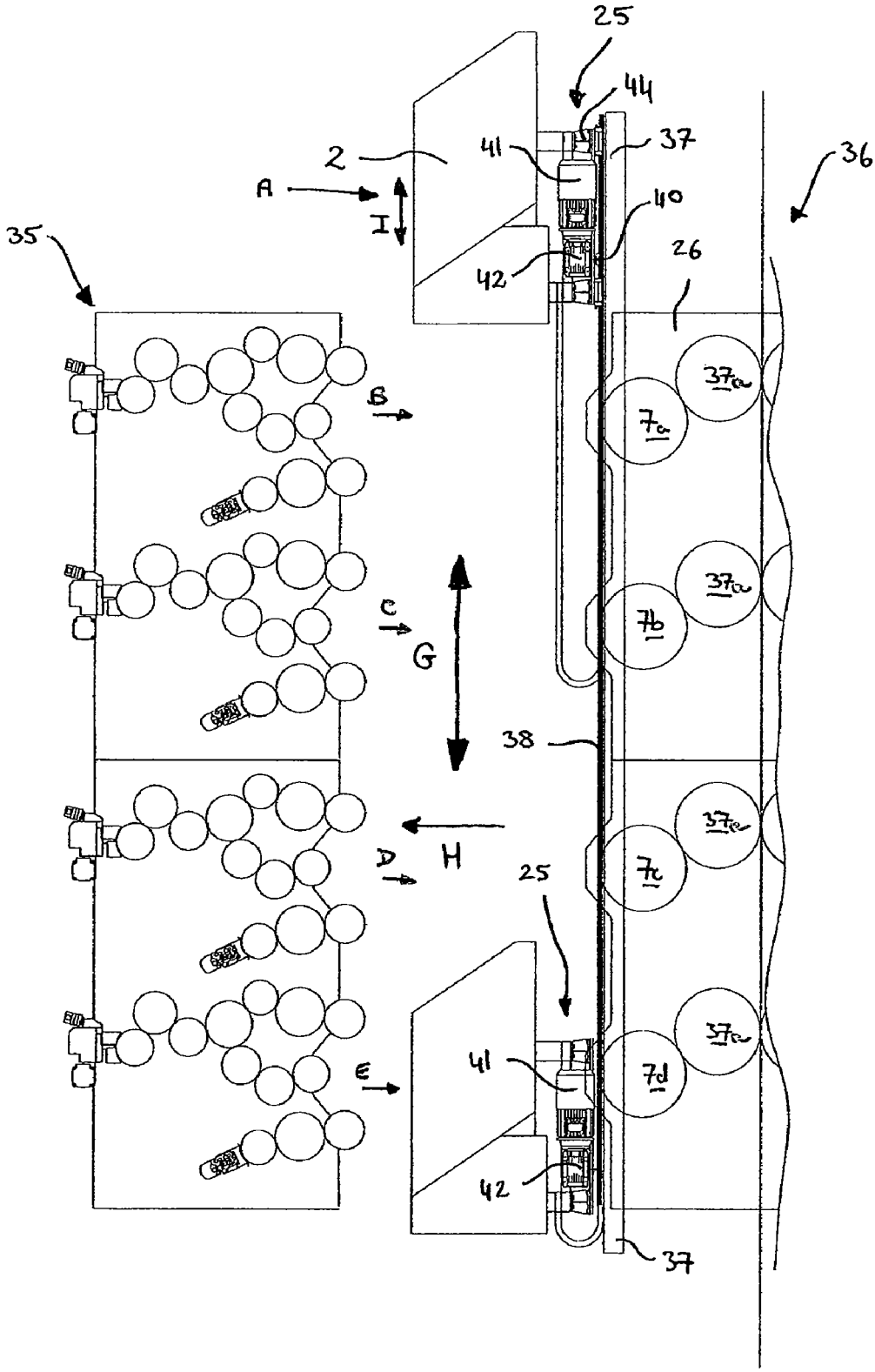
FIG. 12 is a side partial view of a printing unit equipped with the plate loading module shown in FIGS. 7 to 11 and to which a cartridge is releasably attached, the plate loading module and cartridge being shown in two different positions.

As mentioned above, each printing unit is provided with two plate loading modules 25, each module being operable to load printing plates 4 onto the plate cylinders 7 positioned one above the other on one side of the printing press so that the plate loading module 25 only has to move in a vertical direction, as indicated by arrow "G" in FIG. 12. FIG. 12 illustrates a side view of part of a printing unit equipped with a plate loading module 25, as described above, and to which a cartridge 2 containing plate support members 3 is releasably attached so that the plate loading module 25 can load printing plates from one of the plate support members slideably received in the cartridge 2 onto one of the plate cylinders 7*a*-7*d* of the printing unit 36. The plate loading module 25, together with the cartridge 2, can move from a non-operative or parked position indicated by "A" in FIG. 12, in which the plate loading module 25 is above the print unit and in its position ready to receive the cartridge 2, to one of four different positions adjacent to each of the plate cylinders 7*a* to 7*d*. For clarity, the plate loading module 25 is also shown in its lowermost position indicated by "E" in which it is adjacent to plate cylinder 7*d* and operable to load plates from one of the plate support members 3 in the cartridge 2 onto the lowermost plate cylinder 7*d*. However, it will be appreciated that the plate loading module 25 and cartridge 2 can also move into positions B, C and D between positions "A" and "E" which is adjacent to each of the plate cylinders 7*a*, 7*b* and 7*c*, respectively.

It will be appreciated from the side view of FIG. 12, that the plate cylinders 7*a* to 7*d* are fully accessible by the plate loading module 25 and cartridge 2 because the printing unit can split into a pair of inking modules 35 (only one of which is shown in FIG. 12) and a cylinder or primary module 36 (only part of which is shown in FIG. 12) containing only the plate cylinders 7*a*-7*d* and blanket cylinders 37*a*. In FIG. 12, only one of the inking modules 35 is shown in its retracted position in which it has been moved in the direction of arrow "H" away from the cylinder module 36. The retraction of the inking module 35 from the primary module 36 containing the plate and blanket cylinders 7*a*-7*d*, 36 forms the subject of another invention and is described in the Applicant's own co-pending UK patent application no. 0408085.9. It will also be appreciated that when the loading module 25 and cartridge 2 are in the parked position indicated by "A", it is above the top of the printing unit so that the inking unit 35 is able to move between its operative position in which the inking module 35 is operatively associated with the primary module 36 for printing and, a non-operative position, in the direction of arrow "H" and as illustrated in FIG. 12, in which the inking module 35 has been retracted from the cylinder module 36 to facilitate access by the plate loading module 25 and cartridge 2 between the inking module 35 and the cylinder module 36.

Figure 13:
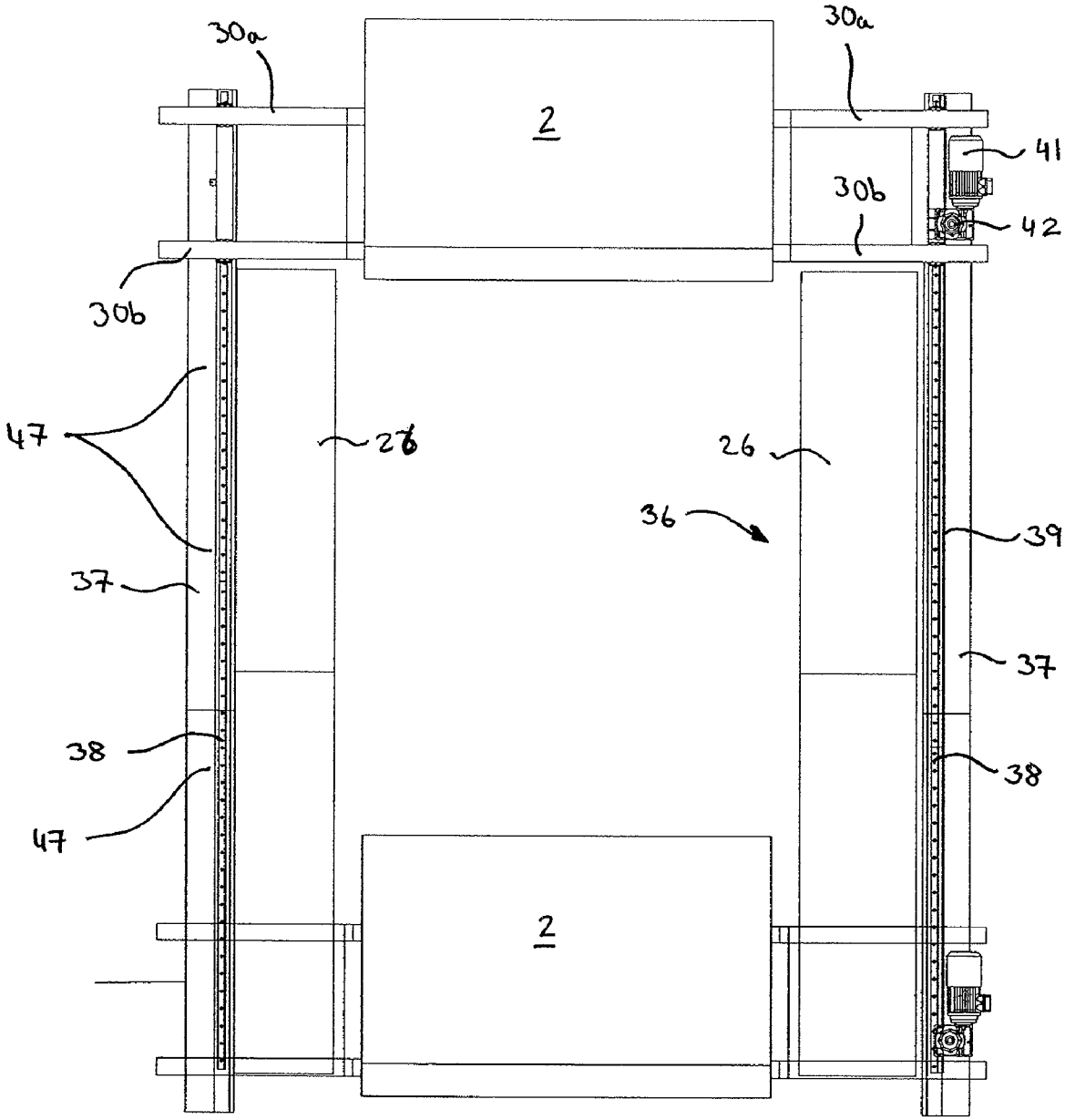
FIG. 13 is a front view of the cylinder module shown in FIG. 12 together with the plate loading module and cartridge being shown in two different positions.
Figure 14A:
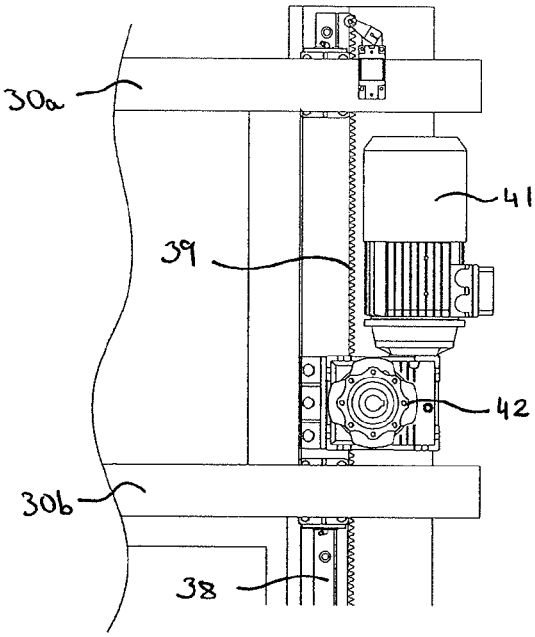
FIGS. 14A and 14B are front and end views respectively of a portion of the plate loading module and cylinder module illustrated in FIG. 13.
Figure 14B:
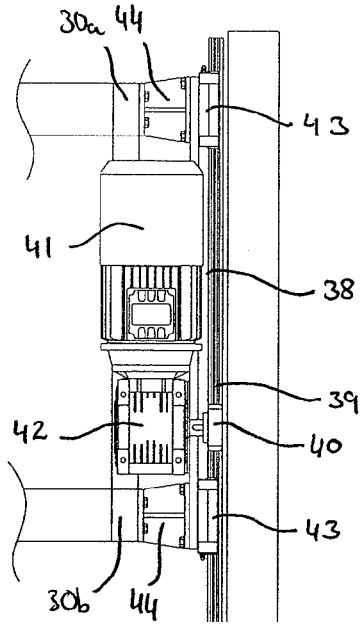
Figure 15:
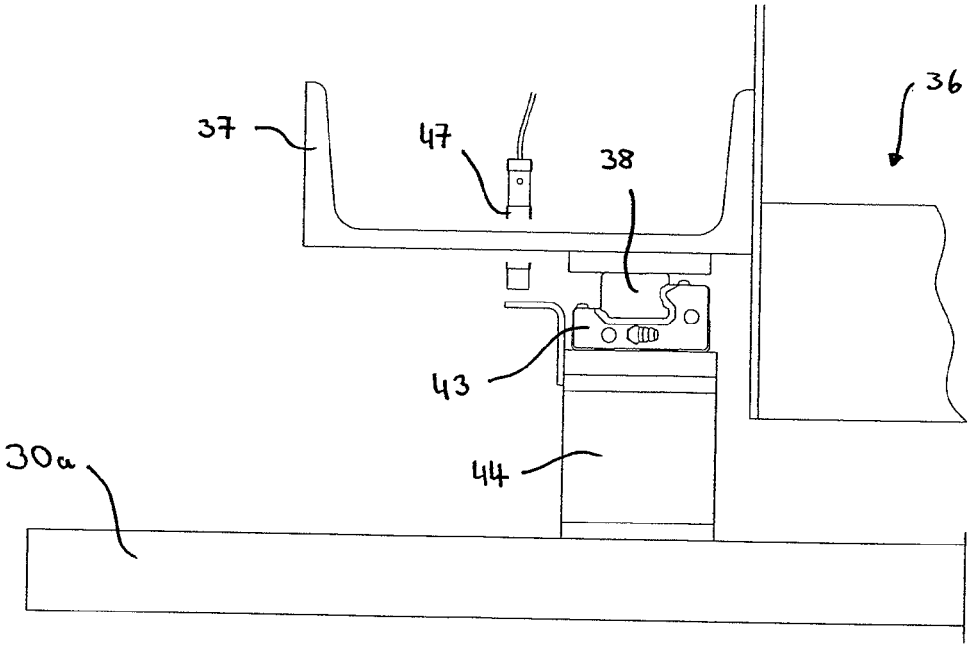
FIG. 15 is a top plan view of a portion of the plate loading module and cylinder module shown in FIGS. 12 and 13.

A preferred assembly to enable movement of the plate loading module 25 between positions A to E in the direction of arrow "G" will now be described with reference to FIGS. 12 to 15 of the drawings. As is most clearly shown from the front view of the cylinder module 36 of FIG. 13, and the top plan view of a portion of the cylinder module 36 shown in FIG. 15, a support member 37 is attached to each of the side frame members 26 to which a guide rail 38 is mounted. On one side, (the right side as illustrated in FIG. 13 and the opposite side to the partial view of FIG. 15), the guide rail 38 includes a toothed rack 39 which is in cooperating engagement with a toothed gearwheel or pinion 40 drivingly engaged to a braked motor 41 via a gearbox 42 mounted on and extending between the bracing cross supports 30*a*, 30*b* of the plate loading module 25. It will be appreciated that the support member 37 extends beyond the top of the printing unit (see FIG. 12) so that the plate loading module can be moved into its parked non-operative position above the printing unit.

Each of the bracing cross supports 30*a*, 30*b* of the plate loading module 25 is provided, on each side, with a linear slideway 43 mounted on a spacing block 44 and containing roller bearings (not shown) which engage with the guide rail 38 so that the plate loading module 25 can slide along the guide rails 38, together with the cartridge 2, between positions A to E in response to operation of the motor 41 which causes the gearwheel 40 to rotate so as to drive the plate loading module 25 along the toothed rack 39 between each of said positions "A" to "E".

To determine the position of the plate loading module 25 relative to each of the plate cylinders 7*a* to 7*d*, a plurality of sensors 47 are mounted on the support members 37 which are operable to detect the location of the plate loading module 25 so that the motor 41 will stop to position the plate loading module 25 in any one of said positions A to E. As mentioned previously, although the position of the plate loading mechanism 25 needs to be relatively accurate, its position is not absolutely critical because the plate support members 3 automatically adjust to the correct position when they extend from the cartridge and engage with a plate cylinder 7.

In an alternative embodiment, the rack 39 and pinion 40 and position sensors 47 can be replaced with an AC servo with encoder feedback and ballscrew arrangement for accurate positioning of the plate loading module 25. Belt or cable drive mechanisms may also be employed.

Figure 16:
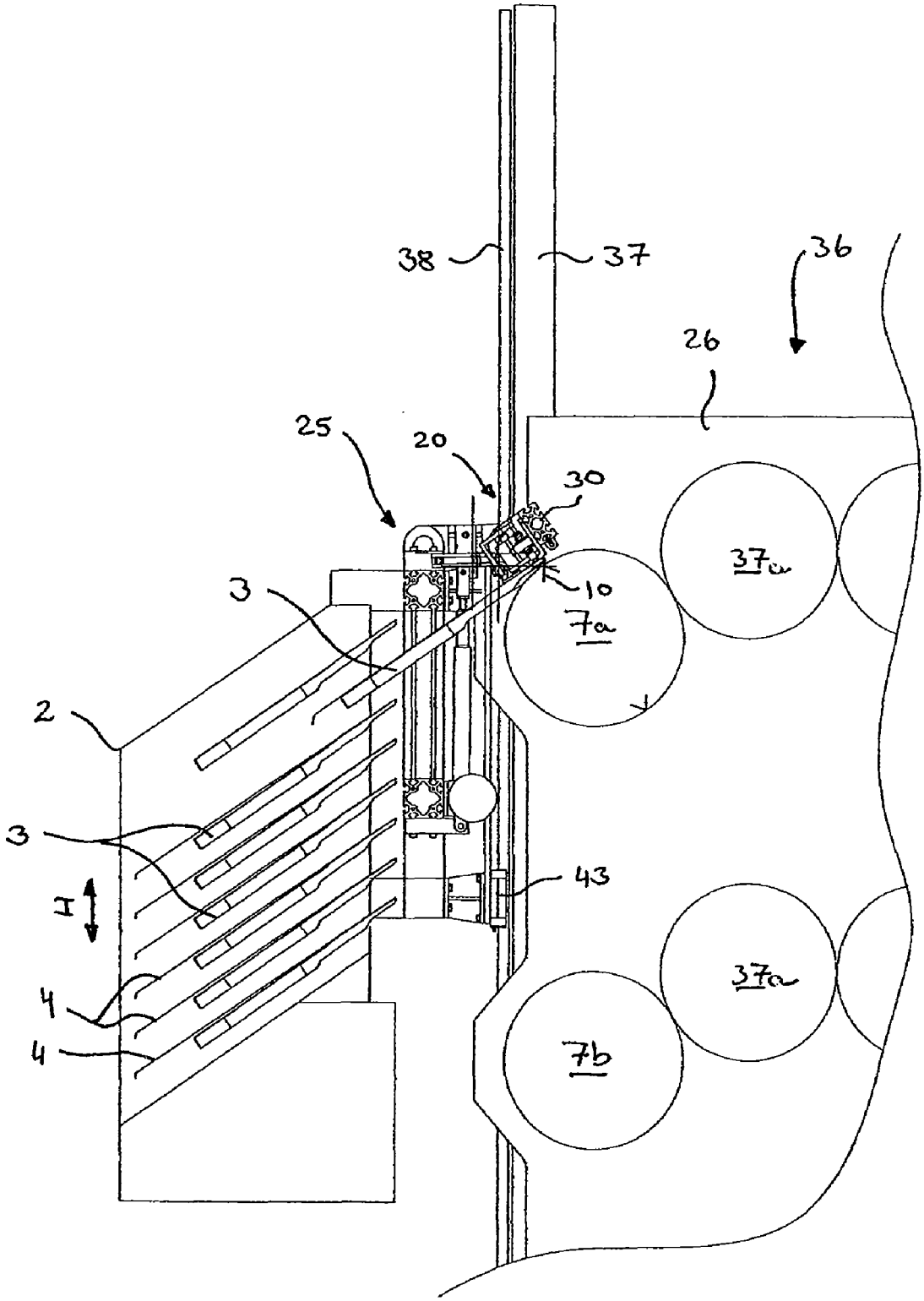
FIG. 16 is a partial side view of the cylinder module together with plate loading module and cartridge attached thereto, the plate loading module being positioned for loading printing plates onto the uppermost plate cylinder and the cartridge being positioned relative to the plate loading module for loading plates from the second uppermost plate support member.
Figure 17:
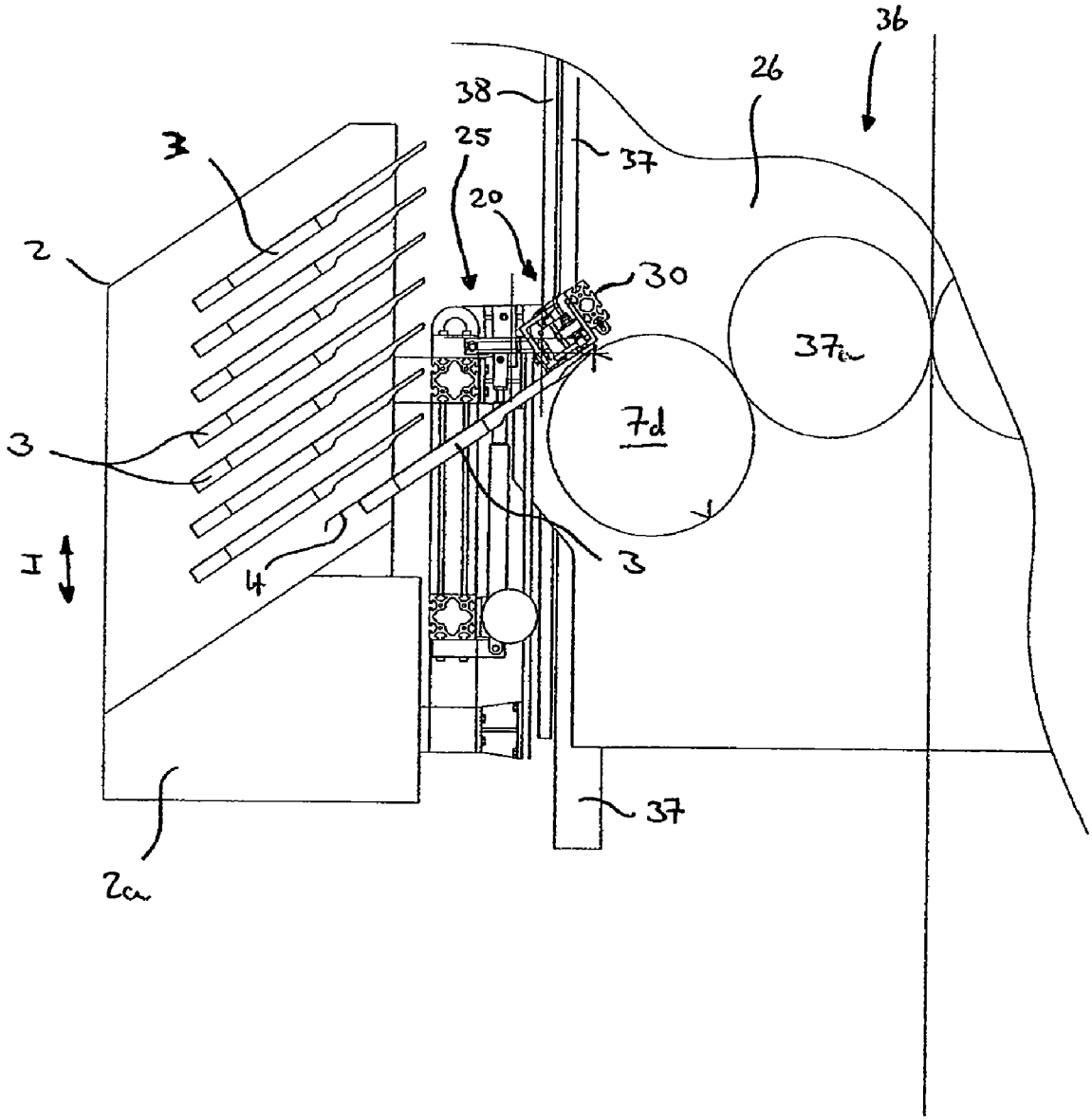
FIG. 17 is the partial side view of FIG. 16 but with the plate loading module positioned for loading printing plates onto the lowermost plate cylinder and the cartridge being positioned relative to the plate loading module for loading plate from the lowest plate support member.
Figure 18:
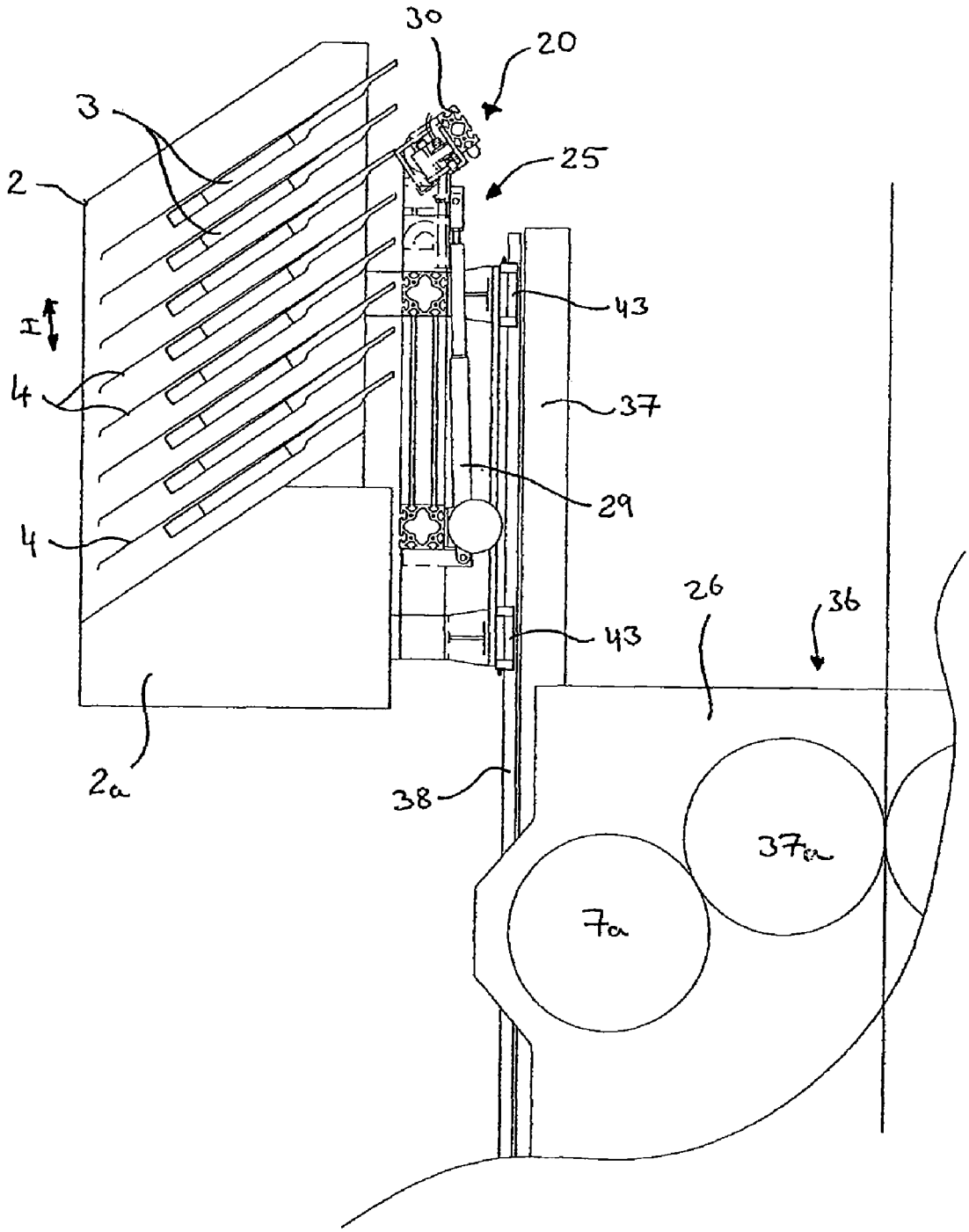
FIG. 18 is the partial side view of FIGS. 16 and 17 but with the plate loading module in its parked position above the cylinder module.

To enable the plate loading module 25 to load printing plates 4 onto a plate cylinder 7 from any of the plate support members 3 located within a cartridge 2, the cartridge 2 is movable, in the direction of arrow "I", with respect to the plate loading module 25 to which it is releasably attached so as to position a selected plate support member 3 in a loading position. FIGS. 16 to 18 show partial side views of the cylinder module 36 in which the cartridge 2 is shown in three different locations with respect to the plate loading module 25. In FIG. 16, the plate loading module 25 is in position "B" to enable printing plates 4 to be loaded onto the uppermost plate cylinder 7*a* and the cartridge 2 is positioned relative to the plate loading module 25 to enable printing plates 4 to be taken from the second highest plate support member 3. In FIG. 17, the plate loading module 25 is in position "E" to enable printing plates 4 to be loaded onto the lowermost plate cylinder 7*d* and the cartridge 2 is positioned relative to the plate loading module 25 to enable the printing plates 4 to be taken from the lowest plate support member 3. FIG. 18 shows the plate loading module 25 in a parked position, indicated by "A" in FIG. 12, in which the cartridge 2 is generally located in a central position relative to the plate loading module 25. The cartridge 2 may be mounted to the plate loading module 2 in a similar way in which the plate loading module 25 is mounted to the cylinder module 36 although it will be appreciated that, as has already been explained in more detail above, the cartridge 2 is preferably separable from the plate loading module 25 so that it can be transported away from the print unit and into, for example, a pre-press plate making area for loading with printing plates 4 and to facilitate removal of any used printing plates 4 therefrom. It will also be appreciated that any one of a number of cartridges can connect to a single plate loading module. It is also envisaged that more than one cartridge could be attached to the plate loading module at a time.

Although the invention has been described with reference to the loading of printing plates 4 onto plate cylinders 7, it will also be appreciated that it can also be used to remove used printing plates 4 from the plate cylinders 7. To facilitate this, the cartridge 2 is provided with a chamber 2*a* beneath the plate support members 3 into which used printing plates 4 are dropped by the plate loading module 25 after they are removed from the plate cylinder 7.

Figure 19:
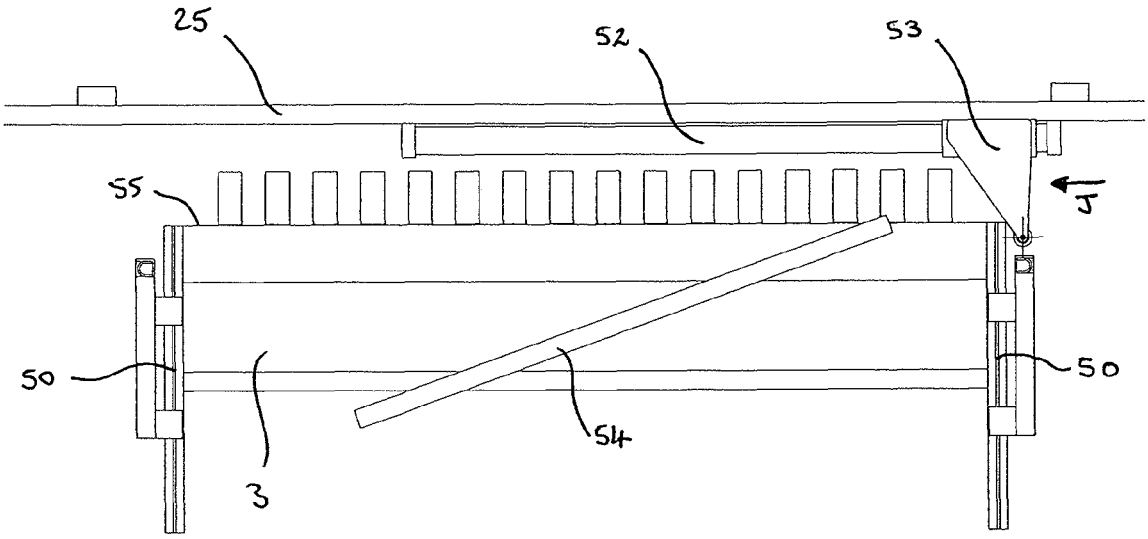
FIG. 19 is a simplified underside view of a plate support member and plate loading module with the plate support member in its retracted position to show how the plate loading module is moved from its retracted to its extended position.
Figure 20:
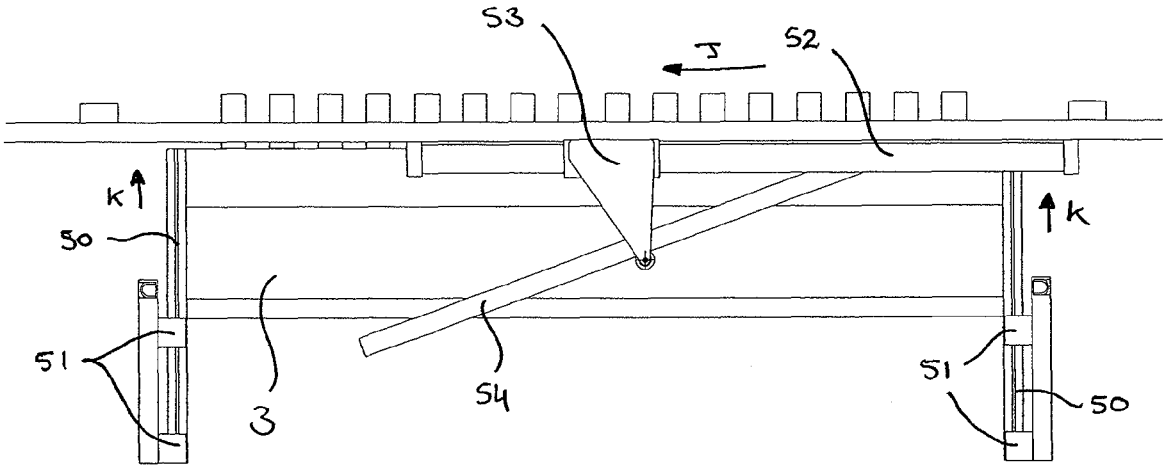
FIG. 20 is the simplified underside view of FIG. 19 in which the plate support member has moved towards its extended position.

An arrangement for moving each of the plate support members 3 from their retracted to their extended positions from the cartridge 2 will now be described in more detail with reference to FIGS. 19 and 20 which illustrate a simplified plan view of the underside of a plate support member 3 when the cartridge 2 is attached to the plate loading module 25. However, the outline of the cartridge 2 has been omitted for clarity. As can be seen in FIG. 19, which shows the plate support member 3 in its retracted state, the plate support member 3 carries a slideway 50 at each end which are mounted on runners 51 attached to the cartridge 2. The plate loading module 25 includes a linear air cylinder 52 mounted to it which extends across part of the width of the plate support member 3 and carries a cam follower 53 thereon operable to slide or traverse along the linear air cylinder 52. The underside of each plate support member 3 carries a cam track 54 which is angled with respect to the front edge 55 of the plate support member 3. The arrangement is such that, when a selected plate support member 3 is positioned at the correct location with respect to the cam follower 53, movement of the cam follower 53 along the linear air cylinder 52 in the direction of arrow "J" in FIG. 20 causes it to cooperate with the cam track 54 and push the plate support member 3 into an extended position in the direction of arrow "K". The plate support member 3 may move in the direction of arrow "K" against a spring bias acting on the plate support member 3 via the runners 51 so that, when the cam follower 53 moves back to its initial position shown in FIG. 19, the plate support member 3 follows it back into its original retracted position. An advantage of this arrangement is that the cartridge 2 itself need not be provided with any power supply as the plate support members 3 are moved by the plate loading module 25 via cooperation between the cam track 54 and the cam follower 53.

It will be appreciated that the printing plate storage module 25 according to the invention provides a simple and efficient way in which to align printing plates 4 ready for loading onto a plate cylinder 7 of a printing unit. As the cartridge 2 is movable from a remote location, such as a pre-press plate making area, to the press, the printing plates 4 can be mounted on the plate support members 3 in their predetermined positions and the cartridge 2 can then be transported to the appropriate printing unit of the press at plate changeover time either automatically or manually. As the cartridge 2 may contain printing plates 4 for several plate cylinders 7, a whole printing unit may be plated up quickly and efficiently if the cartridge 2 is first loaded with all the printing plates 4 for the plate cylinders 7 of a specific print unit. Furthermore, as the plate support members 3 are coupled to the press and, in particular, the plate cylinder 7 to which plates 4 are being loaded, the position of the plates 3 is firmly maintained whilst the plate loading head 20 grasps the printing plates 4.

Many modifications and variations of the invention falling within the terms of the following claims will be apparent to those skilled in the art and the foregoing description should be regarded as a description of the preferred embodiments only.

The invention claimed is:

1. A printing plate module for holding printing plates ready to be transferred onto a plate cylinder of a printing press during a plate loading cycle, the printing plate module comprising a printing plate support member having means to locate printing plates in predetermined positions thereon and engagement means on the printing plate support member for the temporary engagement of the printing plate support member with the printing press during the plate loading cycle to locate printing plates on the plate support member in predetermined positions relative to the plate cylinder of the press onto which printing plates are to be transferred, and a cartridge, the printing plate support member being slidable between a storage position in which the plate support member is received within the cartridge and, a plate loading position in which the printing plate support member extends from the cartridge to enable the engagement means to make temporary engagement with printing press during the plate loading cycle.

2. A printing plate module according to claim 1, wherein the printing plate support member includes means to locate a plurality of printing plates thereon so that each printing plate is located in a predetermined position on the plate support member and, in a predetermined position relative to each of the other printing plates located on the plate support member.

3. A printing plate module according to claim 1, wherein the cartridge is releasably attachable to a plate loading module on the printing press which is operable to transfer printing plates from the plate support member onto the plate cylinder with which the plate support member has become temporarily engaged, the cartridge being detachable from the plate loading module to enable the plate loading module to be moved away from the printing press to facilitate loading of plates onto the plate support member.

4. A printing plate module according to claim 3, comprising a plurality of printing plate support members in the cartridge, each printing plate support member being independently slideable between the storage position and the plate loading position for the transfer of the printing plates from any of the plate support members onto the plate cylinder by the plate loading module.

5. A printing plate module according to claim 4, wherein each plate support member includes a cam track which cooperates with a movable cam member on the plate loading module, when the cartridge is attached thereto, to move the plate support member from the storage into the plate loading position.

6. A printing plate module according to claim 1, wherein the means to locate printing plates on the or each plate support member comprises a plurality of pins on the or each plate support member for engagement in slots formed in a leading edge of each printing plate.

7. A printing press system comprising a printing plate module according to claim 1 and a plate-loading module for transferring printing plates from the plate support member, on which printing plates are located in pre-determined positions, onto a plate cylinder of a printing press during a plate loading cycle in which the printing plate support member is in temporary engagement with the printing press to locate printing plates on the plate support member in a predetermined position relative to said plate cylinder, the plate-loading module comprising a carriage attached to the printing press so that the carriage is movable into positions adjacent to each of the plate cylinders of the press, a support arm attached to the carriage pivotable relative thereto between a plate loading position and a retracted position and, a plate loading head attached to the remote end of the support arm, the plate loading head being operable to engage printing plates located on the plate support member in temporary engagement with the printing press when the support arm pivots towards its loading position so that the printing plates are held by the plate loading head when the plate support member is disengaged and withdrawn from the printing press, further pivotal movement of the support arm into its loading position, after withdrawal of the plate support member from the printing press, being operable to locate a leading edge of the printing plates in a predetermined position on the plate cylinder.

8. A plate-loading module according to claim 7, wherein the plate loading head is pivotally mounted on the support arm to maintain the orientation of the plate loading head relative to the plate support member when the support arm pivots between its retracted and loading positions.

9. A plate-loading module according to claim 8, wherein the plate loading head comprises an array of suction elements which contact the surface of the printing plates when the support arm is pivoted towards its loading position, the suction elements being operable to grasp the printing plates when activated.

10. A plate-loading module according to claim 9, wherein the plate loading head comprises a pressure roller for pressing the printing plates against the plate cylinder once the plate loading head has located the leading edge of the printing plates in a predetermined position on the plate cylinder, as the plate cylinder rotates to wrap the printing plates around the plate cylinder.

11. A plate-loading module according to claim 7, wherein the plate-loading module includes means for releasably attaching the cartridge of the printing plate module thereto.

12. A plate-loading module according to claim 11, wherein a plurality of plate support members are received in the cartridge, the plate loading module being operable to transfer printing plates from any of the plate support members onto a plate cylinder.

13. A printing press comprising a plurality of plate cylinders a printing plate module according to claim 1 and a plate-loading module operable to transfer a plurality of printing plates from plate support members onto the plate cylinders of the press, the plate loading module including a carriage mounted to the press and movable between a non-operative parked position into plate loading positions adjacent to each of the plate cylinders of the press.

14. A printing press according to claim 13, including an elongate guide track mounted on the printing press and a slide unit on the carriage in co-operation with the guide track to enable the carriage to slide along the guide track into positions adjacent to each of the plate cylinders of the press.

15. A printing press according to claim 14, wherein the slide unit comprises pre-loaded roller bearings which co-operate with the guide track.

16. A printing press according to claim 14, including a motor mounted to the carriage for moving the carriage along the track.

17. A printing press according to claim 16, including a pinion in meshing engagement with a toothed rack mounted to the printing press, the pinion being rotatably driven in response to rotation of the motor to move the carriage along the guide track.

18. A printing press according to claim 13, including sensing means to determine the position of the carriage on the guide track so that the carriage can be stopped in different pre-determined positions adjacent to each of the plate cylinders of the press.

19. A printing press according to claim 13, including a primary module, to which the plate cylinders are mounted, and at least one inking module, to which inking systems for applying ink to the plate cylinders are mounted, wherein the inking module is separable from the primary module to facilitate access to the plate cylinders by the plate loading module.

20. A printing press according to claim 19, wherein the carriage is mounted to the primary module so that it can move from its non-operative parked position into its plate loading positions only when the inking module has been separated from the primary module.

21. A printing press according to claim 13, wherein the plate-loading module comprises a carriage attached to the printing press so that the carriage is movable into positions adjacent to each of the plate cylinders of the press, a support arm attached to the carriage pivotable relative there to between a plate loading position and a retracted position and, a plate loading head attached to the remote end of the support arm, the plate loading head being operable to engage printing plates located on a plate support member in engagement with the printing press when the support arm pivots towards its loading position so that the printing plates are held by the plate loading head when the plate support member is disengaged and withdrawn from the printing press, further pivotal movement of mounted to the press and movable between the non-operative parked position into plate loading position adjacent to each of the plate cylinders of the press.

22. A printing press according to claim 21, wherein engagement means to locate each plate support member thereon are located on each plate cylinder.

23. A printing press according to claim 22, wherein the engagement means comprises an end stop member on each plate cylinder.

24. A printing press according to claim 23, wherein the stop member is located at each end of each plate cylinder and is recessed below the cylindrical surface of the plate cylinder.

25. A printing press according to claim 23, wherein at least one end stop member is located at the end of a guide channel.

26. A printing press according to-claim 21, wherein each plate cylinder has a lock-up slot in which a lead edge of each printing plate is inserted by the plate-loading module during a plate loading operation.

27. A method of transferring printing plates, located on a printing plate support member in a printing plate storage module to a plate cylinder of a printing press comprising the steps of:

(a) moving a plate support member together with printing plates located thereon towards the printing press so that the plate support member temporarily engages the press to locate the printing plates in a predetermined position relative to the plate cylinder onto which plates are to be transferred, (b) operating a printing plate loading module to transfer printing plates from the plate support member onto the plate cylinder; and (c) moving the plate loading module together with the plate support member into a position adjacent to one of the plate cylinders onto which plates are to be transferred prior to carrying out step (a), wherein the plate support member is slideably received in a cartridge for movement between a storage position in the cartridge and an extended position for engagement with the press, the cartridge being releasably attachable to the plate-loading module and the method including the step of attaching the cartridge to the plate loading module before carrying out steps (a), (b) or (c).

28. A method according to claim 27, wherein the printing press includes engagement means to temporarily engage the plate support member, the engagement means being located on each of the plate cylinders, the method including the step of rotating the plate cylinder whilst moving the plate support member towards it so that the plate support member engages with the engagement means on the plate cylinder onto which the printing plates are to be transferred to locate the printing plates in a predetermined position relative to said plate cylinder.

29. A method according to claim 27, wherein the cartridge contains a plurality of plate support members and the method includes the step of moving the cartridge relative to the plate loading module to enable the plate loading module to transfer plates from any one of the plate support members onto different plate cylinders of the press.

30. A method of mounting a set of printing plates to a plate cylinder of an offset rotary printing press comprising a plate cylinder having a lock-up slot, the method including the steps of:

(a) locating a set of printing plates in predetermined relative positions on a plate support member, (b) moving the plate support member together with the pre-positioned printing plates located thereon towards the plate cylinder so that cooperating means on the plate support member and on the plate cylinder releasably engage to locate the pre-positioned printing plates in a predetermined position relative to the lock-up slot on the plate cylinder, and (c) operating a printing plate loading module associated with the printing press to convey the pre-positioned printing plates from the plate support member and to insert the lead edge of each printing plate into the lock-up slot whilst maintaining the relative pre-positioning of the printing plates, wherein the plate support member is mounted in a cartridge and the method includes the step of mounting the printing plates on the plate support member in the cartridge in a location remote from the press and moving the cartridge into a plate loading position in which the plate support member can move toward the plate cylinder so that cooperating means on the plate support member and on the plate cylinder releasably engage to locate the pre-positioned printing plates in a predetermined position relative to the lock-up slot on the plate cylinder, and wherein the cartridge includes a plurality of plate support members and the method includes the step of locating a plurality of sets of printing plates in predetermined relative locations on each plate support member.

31. A method according to claim 30, wherein step (b) includes the step of rotating the plate cylinder so that the cooperating means on the plate support member and on the plate cylinder releasably engage.

32. A method according to claim 30, including the step of moving the cartridge into plate loading positions adjacent to different plate cylinders of a press, the plate loading device being operable to convey sets of pre-positioned printing plates from different plate support members onto the same and/or different plate cylinders of the press as the cartridge moves into different plate loading positions.

33. A method according to claim 30, including the step of retracting the plate support member into the cartridge when the plate loading module transfers the printing plates from that plate support member onto the plate cylinder.

* * * * *